US009856705B2

(12) United States Patent
Kannegaard et al.

(10) Patent No.: US 9,856,705 B2
(45) Date of Patent: Jan. 2, 2018

(54) DRILLING RIG

(71) Applicant: Maersk Drilling A/S, Copenhagen K (DK)

(72) Inventors: Michael Kannegaard, Espergaerde (DK); Allan McColl, Glasgow (GB)

(73) Assignee: MAERSK DRILLING A/S, Copenhagen K (DK)

( * ) Notice: Subject to any disclaimer, the term of this patent is extended or adjusted under 35 U.S.C. 154(b) by 0 days.

(21) Appl. No.: 14/760,440

(22) PCT Filed: Jan. 13, 2014

(86) PCT No.: PCT/EP2014/050509
§ 371 (c)(1),
(2) Date: Jul. 10, 2015

(87) PCT Pub. No.: WO2014/108541
PCT Pub. Date: Jul. 17, 2014

(65) Prior Publication Data

US 2015/0354293 A1 Dec. 10, 2015

Related U.S. Application Data

(63) Continuation of application No. 13/772,709, filed on Feb. 21, 2013, now Pat. No. 9,458,680.

(30) Foreign Application Priority Data

Jan. 11, 2013 (DK) ..... PA 2013 70017
Oct. 22, 2013 (DK) ..... PA 2013 70604

(51) Int. Cl.
*E21B 19/00* (2006.01)
*E21B 15/02* (2006.01)
(Continued)

(52) U.S. Cl.
CPC ..... *E21B 19/002* (2013.01); *E21B 15/02* (2013.01); *E21B 19/143* (2013.01); *E21B 19/155* (2013.01)

(58) Field of Classification Search
CPC .... E21B 19/002; E21B 19/155; E21B 19/143; E21B 15/02
See application file for complete search history.

(56) References Cited

U.S. PATENT DOCUMENTS 4,629,014 A * 12/1986 Swisher ..... E21B 19/00 173/141
6,068,066 A * 5/2000 Byrt ..... E21B 15/02 173/152
(Continued)

FOREIGN PATENT DOCUMENTS

NL WO 9931346 A1 * 6/1999 ..... E21B 19/14
NL WO 0218742 A1 * 3/2002 ..... E21B 15/00
(Continued)

OTHER PUBLICATIONS

International Search Report (PCT/ISA/210) mailed on *, by the European Patent Office as the International Searching Authority for International Application No. PCT/EP2014/050509.
Maersk: "Maersk Drilling's Ultra Deepwater Semi-Submersible Rig," Nov. 22, 2011, XP054975504, URL:https://www.youtube.com/watch?v=oguoUL vWVzo.

*Primary Examiner* — James G Sayre
(74) *Attorney, Agent, or Firm* — Buchanan Ingersoll & Rooney PC

(57) ABSTRACT

Embodiments of an offshore drilling rig including—a drill floor deck having a hole defining a first well center;—a first mast upwardly extending relative to the drill floor deck;—a first hoisting system supported by the first mast and configured for hoisting and lowering tubular equipment through the first well center; wherein the load bearing structure of the first hoisting system is displaced from and located on a first side of the first well center;—first pipe handling equipment for moving tubular equipment to the first hoisting system so
(Continued)

as to allow the first hoisting system to hoist or lower the tubular equipment through the first well center; wherein the first pipe handling equipment is operable to move tubular equipment at least partly underneath the load bearing structure and/or through a gap formed in said load bearing structure.

34 Claims, 21 Drawing Sheets

(51) Int. Cl.
*E21B 19/14* (2006.01)
*E21B 19/15* (2006.01)

(56) References Cited

U.S. PATENT DOCUMENTS

| | | | |
|---|---|---|---|
| 6,766,860 | B2 | 7/2004 | Archibald et al. |
| 2003/0159853 | A1 | 8/2003 | Archibald et al. |
| 2011/0017511 | A1 | 1/2011 | Payne |

FOREIGN PATENT DOCUMENTS

| | | |
|---|---|---|
| WO | WO 99/31346 A1 | 6/1999 |
| WO | WO 02/18742 A1 | 3/2002 |

* cited by examiner

DRILLING RIG

TECHNICAL FIELD

The invention generally relates to offshore drilling rigs, such as semi-submersible drilling rigs, drillships or other offshore drilling platforms.

BACKGROUND

Offshore drilling rigs are widely used in the exploration and exploitation of hydrocarbon reservoirs under the sea floor.

One type of drilling structure is the semi-submersible drilling rig that typically obtains its buoyancy from ballasted, watertight pontoons located below the ocean surface and wave action. The operating deck can be located high above the sea level due to the high stability of the design, and therefore the operating deck is kept well away from the waves. Structural columns connect the pontoons and operating deck. Other examples of offshore drilling rigs include drillships.

U.S. Pat. No. 6,766,860 discloses an offshore drilling rig of the semi-submersible type comprising two load paths within the same derrick. The derrick floor is elevated above the rest of the drilling deck. Rotary tables are positioned in the drill deck below the primary and secondary hoisting paths. On the drill deck, drill pipe and the drill bit is made up and run through the water column to the sea bed where it is rotated by either the rotary table and/or a rotating mechanism (top drive) suspended in the derrick. Later, casing tubulars are assembled in one of the hoisting paths and run into the hole. Ramps feed pipes to the primary and secondary hoisting paths respectively.

It is generally desirable to provide an offshore drilling rig that allows for a more efficient and flexible operation. It is further generally desirable to provide an offshore drilling rig that facilitates operation with a high degree of safety.

SUMMARY

According to a first aspect, Disclosed herein are embodiments of an offshore drilling rig comprising a drill floor deck having a hole defining a first well centre. Embodiments of the drilling rig further comprise a first mast upwardly extending relative to the drill floor deck, and a first hoisting system supported by the first mast and configured for hoisting and lowering tubular equipment through the first well centre, wherein the load bearing structure of the first hoisting system is displaced from and located on a first side of the first well centre. Embodiments of the drilling rig further comprise first pipe handling equipment for moving tubular equipment to the first hoisting system so as to allow the first hoisting system to hoist or lower the tubular equipment through the first well centre wherein the first pipe handling equipment is operable to move tubular equipment at least partly underneath the load bearing structure and/or through a gap formed in said load bearing structure.

In some embodiments, the first pipe handling equipment is also arranged to present the tubular equipment to the hoisting system i.e. such that the upper end of the tubular equipment is within reach of a top drive, hook or similar connection device of the hoisting system, allowing the hoisting system to subsequently suspended the tubular equipment over the well centre (in this case the first hoisting system and first well centre, respectively). In some embodiments, the tubular equipment is presented while still at least partially underneath the load bearing structure and/or in the gap formed in the load bearing structure. In the present disclosure the expressions presenting tubular equipment to a well centre, the respective hoisting system of that well centre and feeding tubular equipment to a well centre are used interchangeably.

Due to the considerable length of tubular equipment, the pipe handling equipment (which to some extent governs the path of the tubular being presented), the mast and the load bearing structure of the hoisting system must be arranged to allow the tubular equipment to be raised to vertical without colliding with the drilling rig. For instance, the tubular equipment may be presented via pipe handling equipment in the form of a slanted chute partially or completely below the drill floor deck. As the tubular is raised to vertical above the well centre it may collide with the mast or the load bearing structure unless a sufficient gap herein is provided and/or the pipe handling equipment and the drilling rig are arranged to allow the lower end of the tubular to swing towards the well centre as it is raised. Typically, a gap will be preferable as the bearing structure of the drilling rig and/or the equipment suspended over the moon-pool area below the well centre (e.g. riser string, riser tensioners) may not allow the lower end of the tubular to shift sufficiently.

Consequently, as the load bearing structure of the first hoisting system is displaced from and located on the first side of the first well centre, access to the well centre is facilitated not only for human operators but also for equipment, including some tubular equipment and other large equipment that does not have to be manoeuvred through openings of the mast structure in order to have access to the well centre. In particular, access to the well centre is facilitated from at least three sides other than the first side. In some embodiments, the first mast may also be displaced from and located on the first side of the first well centre. This is in contrast to conventional derrick structures that surround the well centre, i.e. where the well centre lies within the foot print of the derrick, normally at or in close proximity to the geometrical centre of the footprint. In such systems, all lateral access has to pass through lateral openings of the derrick structures, which are often formed as an inverted V in the sides of the structure and which are referred to as V-doors. Nevertheless, despite the presence of such openings, access is restricted by the mast structure, in particular by the width and height of any such openings. The first mast may comprise an opening aligned with the gap in the load bearing structure and shaped and sized so as to allow tubulars to be fed through the opening in the mast and through the gap to the well centre.

The first pipe handling equipment is operable to move tubular equipment at least partly underneath the load bearing structure and/or through a gap formed in said load bearing structure. A longitudinal direction may be defined within a plane of the drill floor deck by the first well centre and the first hoisting system. In some embodiments, The first hoisting system and, optionally, the first mast are configured to allow tubular equipment to be moved towards the first well centre along the longitudinal direction from the first side, i.e. the same side on which the hoisting system is located. Consequently, the pipe handling equipment does not need to take up space on the second side of the well centre, thus providing a more open drill floor. The first and second sides may be distinguished by an axis through the first well centre dividing the first and the second side form each other where the load bearing structure of the hoisting system intersects the plane defined by the drill floor deck only on the first side.

in some embodiments, tubular equipment may be moved to the well centre from both sides of the well centre (in the longitudinal direction), thus allowing tubular equipment from multiple storage areas, and using different pipe handling equipment, to be moved while keeping a large open drill floor deck area free.

To this end, the first hoisting system and, optionally, the first mast may define an opening through which tubular equipment is movable towards the first well centre from the first side. Alternatively or additionally the tubular equipment may be at least partly moved underneath the load bearing structure, e.g. even below the drill floor deck. In some embodiments, the first hoisting system comprises a plurality of cylinders or other support members extending upwards relative to the drill floor deck, wherein the support members are arranged as two or more groups of support members that are laterally spaced apart from each other so as to allow tubular equipment to be moved towards the well centre from the first side along the longitudinal direction through a gap between the two groups of support members. Alternatively or additionally, the cylinders may be positioned elevated relative to the drill floor on a foundation, which is part of the load bearing structure, and the tubulars may be moved through a gap in the foundation. Alternatively or additionally, one or more of the support members may be displaced from each other in the longitudinal direction. It will be appreciated that a gap in the load bearing structure, e.g. between the support members, enables a compact pipe handling solution which in turn enables an open drill floor. The gap is shaped and sized so as to allow tubular equipment to be fed through the gap. In some embodiments, the gap is at least 0.5 m, such as at least 1 m wide, such as at least 2 m wide, such as at least 3 m wide. Consequently, a central and direct pipe feeding path for tubulars to the well centre is provided. Tubulars may be fed at least partially, such as completely, through the gap and even be presented to a top drive in a single forward and/or upward motion path. Each group of support members may comprise one or more cylinders or other support members, e.g. 2, 3, or even more cylinders, typically depending on the desired hoist capacity. The well centre may be longitudinally displaced from an area between the two groups of support members so as to allow access to the well centre also from the transverse direction. In particular, the well centre may be displaced from each axis connecting two of the support members. To this end, the support members may support one or more sheaves whose axis extends in the direction connecting the groups of support members. The drilling rig may further comprise a storage structure for storing tubular equipment positioned longitudinally displaced from the first well centre on the first side of the first well centre, and the first pipe handling equipment may be operable to move tubular equipment from the storage structure to the first well centre.

For example, in some embodiments risers and/or another type of tubulars (such as those mentioned above) may be stored on the first side of the well centre (e.g. on the opposite side of the mast than the well centre), while other types of tubulars, such as drill pipes and/or casings, may be stored and/or assembled to stands on the second side, opposite the first side. Alternatively or additionally, the storage and/or stand-building of drill pipes and/or casings may be performed at a position transversely displaced from the well centre. In some embodiments, the pipe storage structure on the first side is to support heavier tubular equipment such as riser sections and/or casing. In some embodiments drill pipe and/or casing, and or stands of drill pipe or casings may be stored in the storage structure on the first side of the well centre (e.g. on the opposite side of the mast than the well centre), while risers may be stored on the second side, opposite the first side, or transversely displaced from the first well centre. The stand-building of drill pipes and/or casings may thus be performed at a position on the first side, e.g. behind the hoisting system when seen from the first well centre.

In some embodiments, the pipe storage structure on the first side is arranged to store tubulars in vertical position. The pipe storage structure may be located at the same level as the drill floor deck or at least partially at a different level, e.g. a lower level so as to allow tubulars to be advanced along a sloping direction through the opening/gap in the hoisting system.

For the purpose of the present description, the term "mast" refers to a support structure upwardly extending relative to the drill floor deck and supporting a hoisting system for hoisting and lowering tubulars (such as drill strings, casings and/or risers) towards the seabed e.g. such that drilling into the seabed can be performed. The mast may extend from the drill floor deck or from a deck different from the drill floor deck. In any event, the mast including the load bearing structure of the hoisting system defines a footprint on the drill floor deck or at least within a plane defined by the drill floor deck. The footprint may be defined as the space in the plane defined by the drill floor deck that is occupied or enclosed by the mast structure and the load bearing structure of the hoisting system, i.e. as a cross-section of the mast and the load bearing structure of the hoisting system in the plane of the drill floor deck. The position of the mast may be defined by a geometrical centre of the footprint.

In some embodiments, the first hoisting system comprises one or more sheaves, one or more hoisting lines extending over the sheaves and operable to carry the tubular equipment when raised or lowered through the first well centre; and at least two support members extending upwardly relative to the drill floor deck and configured to carry the sheaves and weight of the tubular equipment transferred by the hoisting lines and the sheaves; and wherein the two support members are positioned spaced apart from each other so as to form a gap between the two support members through which gap tubular equipment is movable towards the first well centre from the first side. The hoisting system may be a hydraulic hoisting system comprising upwardly extending cylinders or other actuators for carrying the load to be hoisted or lowered typically via large sheaves mounted on top of the cylinders. The load bearing structure of a cylinder rig thus comprises the cylinders and the one or more sheaves which may be in the form of a sheave cluster. The footprint of such cylinders in the plane of the drill floor deck is also part of the mast footprint. The cylinders may extend from the drill floor deck or from a foundation below or elevated above the drill floor deck. The loads exerted on the hoisting system during lowering or hoisting of equipment in or out of the well centre can be said to be at least partially transferred to the drilling rig via cylinders. Hence, in such embodiments, the mast predominantly supports the hoisting systems in the horizontal direction while the load is carried by the cylinders. In some embodiments, the hoisting system may be a drawworks system. For such systems the sheaves are carried by other suitable support members, such as upwardly extending columns and/or other load-bearing parts of the mast structure. In both cases, loads are transferred to the drilling rig via the load bearing structure which may be integrated into or separate from the mast. The load bearing structure comprises the sheaves and the support members that carry the sheaves and any load suspended from the sheaves. In other words, generally, the load bearing structure transfers substantially the entire weight of the hoisting system and of the load suspended from it to parts of the drilling rig at or below the drill floor deck level.

In some embodiments, one end of the hoisting line is anchored on one side of the load bearing structure, opposite the side on which the first well centre is located, e.g. such that the forces transferred via the sheaves and the support members carrying the sheaves are substantially vertical. The draw-works drum and/or motor may be completely or partially encapsulated by the mast structure. In some embodiments, the hoisting lines may be anchored to the drilling rig via a number of anchoring members such as compensators, e.g. a number of cylinders. These anchoring members may be arranged in two groups of anchoring members so as to form a gap between the two groups of anchoring members where the gap is aligned with the gap between the support members so as to allow tubulars to be fed through the gap between the groups of anchoring members. In some embodiments, the hoisting line or lines may be attached to the anchoring members via a yoke extending across the gap between the anchoring members at a height above the drill floor deck sufficient to allow tubulars to be fed through the gap between the anchoring members and below the yoke.

Generally, throughout the present disclosure, reference to a hoisting system supported by the mast not only refers to embodiments where the mast carries a part of the weight of the hoisting system (and/or any load carried by the hoisting system), but also to embodiments where the mast supports the hoisting system only, or at least predominantly, against lateral/horizontal forces.

In some embodiments, a longitudinal direction may be defined in the plane of the drill floor deck as a direction extending through the first well centre and through the position of the first hoisting system. In some embodiments, the position of the first hoisting system within the plane of the drill floor deck may be defined as a position of a centre of mass of the top sheave(s) of the first hoisting system over which the hoisting lines of the first hoisting system are run. In some embodiments of a cylinder hoisting system, the top sheave is a traveling sheave or cluster of sheaves supported and pushed upwards by the cylinders. In draw-works system the top is typically fixed to support members at a fixed vertical position relative to the mast. In many embodiments, the rig is equipped with a top drive arranged to rotate drill strings and lower them through the first well centre; the top drive is arranged to be lifted by the first hoisting system. To keep the top drive from rotating a guide-dolly is typically arranged to slide along a vertically extending guides, e.g. rail or rails, while being connected to the top drive. The rails may be part of or attached to the first mast. In some embodiments the longitudinal direction may thus be defined in the plane of the drill floor deck as a direction extending through the first well centre and through the position of the this rail or, in case of multiple rails, a centre point of said rails. In some embodiments the centre point is calculated by weighing the position of each of the rails with a fraction of the rotational force from the top drive that the rails absorb. Similarly, a transverse direction may be defined within the plane of the drill floor deck as extending normal to the longitudinal direction.

In some embodiments, the first mast defines a footprint on the drill floor deck, where the drill floor deck extends outside the footprint. The drill floor deck area extending outside the footprint of the first mast may be sized and shaped so as to allow installation of skid beams for skidding equipment and/or for a forklift or other vehicles to operate on the drill floor deck area outside the mast footprint. In some embodiments, skid beams are installed on the drill floor deck. For example, the drill floor deck area outside the mast footprint may be at least 200 $m^2$, such as at least 500 $m^2$, such as at least 1000 $m^2$, such as at least 2000 $m^2$, e.g. at least 5000 $m^2$. In particular, the first well centre may be located outside the footprint defined by the first mast, and the first well centre may be displaced from the footprint along the longitudinal direction. In some embodiments, the drill floor deck comprises one or more open drill floor deck areas not otherwise obstructed by fixed installations such as the first mast, further masts, pipe handling equipment, and/or the like, as will be described in more detail below.

In some embodiments, the drill floor deck and, in particular, the part in direct proximity to the well centre is stationary without the need to hoist or lower parts of the drill floor deck to allow running (i.e. lowering) the blow-out preventer (BOP) and/or other heavy subsea equipment (e.g. the Christmas tree). In some embodiments, the BOP and/or other heavy subsea equipment is stored on a deck below the drill floor deck. Consequently, such subsea equipment does not take up space on the drill floor deck.

The term well centre refers to a hole in the drill floor deck through which the drilling rig is configured to lower tubulars towards the seabed and, in particular, through which tubulars may be lowered all the way to the seabed. A well centre is sometimes also referred to as a drilling centre. It will be appreciated that the drill floor deck may comprise additional holes such as foxholes and mouseholes that may e.g. be used for building stands of tubulars but through which the drilling rig cannot lower tubulars to the seabed and/or through which the drilling rig cannot perform drilling into the seabed e.g. by lacking a system arranged to rotate a drill string with sufficient force such as a top-drive or a rotary table. In some embodiments, such an additional hole is a hole in the drill floor deck through which the drilling rig cannot progress a drill string through a riser system. In some embodiments, a well centre is differentiated from an additional hole by having a diverter and/or a diverter housing arranged below so that drill string passed through the well centre extends through said diverter or diverter housing.

The offshore drilling rig may be a semi-submersible drilling rig, i.e. it may comprise one or more buoyancy pontoons located below the ocean surface and wave action, and an operation platform elevated above the ocean surface and supported by one or more column structures extending from the buoyancy pontoon to the operation platform. Alternatively, the offshore rig may be of a different type, such as a jack-up drilling rig or a drill ship.

In some embodiments, the first pipe handling equipment defines a first pipe feeding path along which tubular equipment is moved towards the first well centre. In particular, the first pipe feeding path may intersect the first well centre.

In some embodiments, the drilling rig comprises second pipe handling equipment for moving tubular equipment to the first hoisting system so as to allow the first hoisting system to hoist or lower the tubular equipment through the first well centre. The second pipe handling equipment may define a second pipe feeding path along which tubular equipment is moved towards the first well centre. In particular, the second pipe feeding path may intersect the first well centre; the second pipe handling equipment may be configured to move tubular equipment towards the first well centre from a second side of the well centre, opposite the first side on which the mast is located. The second pipe feeding path may be a straight path or it may have a different shape, e.g. comprise multiple path sections, one, some or all of which may be straight. When the second pipe feeding path extends substantially along the longitudinal direction (at least proximal to the well centre such as e.g. within 1 m or more, such as within 2 m or more, such as within 3 m or more, such as within 4 m or more, such as within 5 m or more, such as within 10 m or more) lateral drill floor deck areas extending transversely adjacent the well centre may be kept free of pipe handling equipment, such as pipe rackers, iron roughnecks etc. and, in particular, free of horizontal pipe handling equipment such as tubular feeding machines, e.g. catwalk machines. Also, for embodiments where the drilling rig comprises further well centre(s) arranged along the transverse direction arranging the pipe handling equipment on the second side may allow pipe handling equipment to service more than one well centre and/or pipe handling equipment servicing the first well centre may cooperate with the pipe racking equipment servicing a second well centre. Similarly, when the second pipe feeding path extends substantially along the transverse direction, drill floor deck areas extending longitudinally adjacent the well centre may be kept free of pipe handling equipment. In the latter case tubulars are typically moved from a storage area located at the first side and/or transversely located relative to the well centre. Here, the term substantially along the longitudinal direction or transverse direction is intended to refer to a direction parallel to said direction and directions slightly deviating from said direction such as within +/−30°, e.g. +/−20°, +/−10°, such as +/−5°.

The term tubular equipment is intended to refer to tubular equipment that is advanced through the well centre towards the sea floor during one or more stages of the drilling operation. In particular, the term tubular equipment refers to straight tubular elements that can be joined to form a string of tubular equipment. The tubular equipment may be selected from drill pipes and/or other tubular elements of the drill string, risers, landing strings, liners and casings. Examples of tubular elements of the drill string include drill pipes, drill collars, etc. For the purpose of the present description, tubular equipment will also generally be referred to as tubulars. Tubulars may have varying lengths and diameters. Drill pipe typically has a length between 33' to 45' and diameters of up to 19" or even 20". Prior to advancement through the well centre, drill pipes are normally assembled to stands of two, three or even more stands of drill pipe, so-called doubles, triples etc. The building of stands is performed by dedicated stand-building equipment and/or by a hoisting system. Once assembled, the stands are normally stored in a set-back area, typically in upright position supported by e.g. fingerboards. Riser joints typically have lengths between 50' and 90' and diameters of up to 70".

In some embodiments, the first and/or second pipe handling equipment comprises horizontal pipe handling equipment for handling horizontally oriented tubular equipment, and/or vertical pipe handling equipment for handling at least vertically oriented tubular equipment. Consequently, the first and/or second pipe handling equipment may allow tubulars from different types of storage/setback areas for storing tubulars at different orientations to be moved to the well centre and/or between one or more storage areas using a common pipe feeding path, thus allowing other drill floor deck areas to be kept free of pipe handling equipment. Alternatively or additionally, the pipe handling equipment may comprise devices for changing the orientation of tubulars and/or equipment for advancing tubulars in a slanted direction e.g. upwards from a recessed storage location. Such equipment may comprise a slide, a specially designed pipe racker with a travelling upper arm for raising pipes or chute.

A setback area is a tubular storage area, typically in direct communication with one or more well centres (via pipe handling equipment), where tubulars can be stored ready and quickly retrieved to be lowered towards the seabed, and tubulars can be set back. In many cases tubulars will be transported to another storage area or off the drilling rig during transit due to the substantial weight and/or higher centre of gravity of the setback area relative to the motions of the drilling rig in the sea. Tubulars are typically stored vertically as this is convenient because the tubulars do not require a complete rotation before being run; however, tubulars may in principle be stored in horizontal position or both. These tubulars may also be stored in the setback area when tripping tubulars out of the well centre. Typically, a setback is suitable for storing and receiving stands (i.e. 2 or more joined single tubulars, such as triplets) of drill pipe and/or casing in varying diameters. Storing tubulars in stands saves time in a drilling operation because fewer connections have to be made when running in the hole (the well center) and broken when tripping out of the hole. In such cases vertical storage is preferable because storing stands (which are typically very long) horizontally requires a large footprint. The setback will comprise equipment for holding the pipes, such as fingerboard systems for storing vertical tubulars, which will be designed to accommodate one or more diameters of tubulars. It is therefore typical that the setback will have designated areas for holding e.g. drill-pipe and casings depending on diameter. Accordingly, in some embodiments a setback area is a tubular storage arranged to store stands of drill pipe, casing (optionally of varying diameters) or both. Such stands may be stands of 2 or more, such as of 3 or more, such as 4 or more. In some embodiments the setback further comprises pipe handling equipment (such as a pipe racker) arranged to deliver stands to and from the holding equipment of the setback area and present the stand to the hoisting system (typically the hook or top-drive) or hand over the stand to another machine in the pipe handling equipment (such as a chute or a further pipe racker machine) which performs the presentation. A setback is also typically combined with stand building equipment which is arranged to receive singles and connect those into a stand after which the stand is set back in the setback area ready to be run in the hole.

The horizontal pipe handling equipment may configured to move tubular equipment along a pipe feeding path towards the first well centre, e.g. along a straight pipe feeding path. For example, tubulars may be moved from a horizontal storage area by means of the horizontal pipe handling equipment and raised into a vertical orientation by means of the vertical pipe handling equipment, the hydraulic hoisting system, the horizontal pipe handling equipment, and/or by two or more of such devices cooperating with one another. Similarly, tubulars from a vertical storage position may be moved to the well centre by the vertical pipe handling equipment.

The horizontal pipe handling equipment may be any suitable apparatus or device for moving tubulars in a horizontal orientation and/or for raising—alone or in cooperation with other pipe handling equipment—tubular equipment from a horizontal to a vertical orientation. Examples of horizontal pipe handling equipment include catwalk machines, such as catwalk shuttles. The vertical pipe handling equipment may be any suitable apparatus or device for moving tubulars in a vertical orientation and/or for changing—alone or in cooperation with other pipe handling equipment—the orientation of tubular equipment, e.g. between a horizontal and a vertical orientation. Examples of vertical pipe handling equipment include column rackers, hydrarackers, and other types of rackers, hydraulic arms, etc. or combinations thereof.

In some embodiments, the second pipe handling equipment comprises a horizontal pipe handling equipment extending along the second pipe feeding path; and vertical pipe handling equipment for handling at least vertically oriented tubular equipment. The vertical pipe handling equipment may be movable between at least a first position on the second pipe feeding path between the horizontal pipe handling equipment and the first well centre and a second position laterally displaced relative to the second pipe feeding path. Generally, vertical and horizontal pipe handling equipment may cooperate with each other and/or with the hoisting system of the first mast to perform a variety of pipe handling operations. In particular the pipe handling operations do not occupy unnecessary drill floor deck area and do not affect operations that are simultaneously performed at other drill floor deck areas, thus leaving one or more drill floor deck areas free of pipe operations such as an open drill floor deck area as discussed below. In particular, in the above example, when the vertical pipe handling equipment is at the first position it may be configured to receive tubular equipment from the first horizontal pipe handling equipment. Moving the vertical pipe handling equipment to the second position, on the other hand, allows tubular equipment to be moved by the horizontal pipe handling equipment directly to the first well centre. To this end, the horizontal pipe handling equipment may be movable, e.g. on rails or skid beams or another suitable guide, along the second pipe feeding path to and away from the first well centre.

The horizontal pipe handling equipment may be located on the drill floor deck, i.e. on the same level as the drill floor deck. Furthermore, the horizontal pipe handling equipment may be surrounded by drill floor deck areas shaped and sized to allow human operators and/or movable equipment such as forklifts and/or skiddable equipment to move alongside (i.e. parallel to the long side of the pipe when handled by the horizontal pipe handling equipment) and/or around the horizontal pipe handling equipment and/or between the horizontal pipe handling equipment and other parts of the drill floor deck including the well centre. Due to the absence of height differences such movement is further possible in a safe and efficient manner.

For the purpose of this description, the term drill floor deck is intended to refer to the deck of an operating platform of an offshore drilling rig immediately above which joints of tubulars are assembled to form the drill string which is advanced through the well centre towards the seabed. The part of the drill floor deck in immediate proximity of the well centre is normally referred to as the drill floor, which is the primary work location for the rig crew and/or machines performing similar functions, such as iron roughnecks. The drill floor normally comprises a rotary table for rotating the drill string. For the purpose of the present description, the term drill floor deck includes the drill floor located directly under/next to the mast and surrounding the well centre as well as deck areas on the same level as and connected with the drill floor by uninterrupted floor area on the same level, i.e. the deck area where human operators and movable equipment such as forklifts, equipment moved on skid-beams, etc. can move around and to/from the well centre; in some embodiments without having to climb/descend stairs or other elevations. The drill floor deck is typically the floor of a platform, e.g. the lowest platform, above the diverter system. Diverter systems for offshore drilling rigs are typically provided beneath the drilling rig rotary table. Such a diverter system provides a vent line and ensures that the flow may be directed away from the drilling rig. Hence, in some embodiments, the offshore drilling rig comprises a diverter system under the first well centre.

At least parts of the drill floor deck may be formed by the roof of a housing or enclosure accommodating mud mixing equipment and/or other operational equipment of the drilling rig, thus allowing for a compact and space-saving arrangement of equipment on the drilling rig. For example, the drill floor deck may comprise a storage area for storing tubular equipment such as drill pipes, casings, risers, etc., e.g. a storage area for storing tubular equipment in horizontal orientation. The storage area may be located next to the horizontal pipe handling device or, if this is movable, next to the pipe feeding path along which the horizontal pipe handling device may travel. In some embodiments, the pipe storage area and/or horizontal pipe handling equipment may be partially or completely surrounded by open drill floor deck area, e.g. drill floor deck area shaped and sized to allow vehicles or skiddable items to be moved around the pipe storage area.

In some embodiments, the drill floor deck comprises at least a first open or unobstructed drill floor deck area located adjacent to the first mast, e.g. in the longitudinal or transverse direction of the first mast, other than any drill floor deck area used for movement of tubular equipment to the first well centre, and free of any mast or tubular storage structures or other fixed installations. Hence, the open drill floor deck area extends outside the mast structure. Consequently, the drilling rig provides an open or free drill floor deck area for placing and/or moving auxiliary equipment and/or for handling and/or operating such auxiliary equipment while at the same time allowing efficient and safe access to the well centre. Examples of such auxiliary equipment include logging-while-drilling equipment, measuring-while-drilling equipment, coiled tubing equipment, etc. and similar equipment other than the tubulars making up the drill string, well casing/lining or risers and other than heavy subsea equipment such as BOPs and Christmas trees. Generally, auxiliary equipment may comprise on-deck auxiliary equipment and suspendable auxiliary equipment such as down-hole equipment that may be hoisted through the well centre from a gantry or mounting structure. For example, auxiliary equipment may comprise a suspendable component and an on-deck component e.g. a reel on which coiled tubing or wire is spooled for use for suspending the suspendable component through the well centre. Other examples of on-deck auxiliary components comprise supply and/or similar support components for supplying the suspendable component with energy or other supplies that otherwise support the suspendable equipment.

In some embodiments, the drilling rig is configured to perform movement of tubular equipment, in particular risers, casing, liner, elements of the drill string, to the first well centre along a pipe feeding path that only crosses drill floor deck areas outside the first open drill floor deck area. Consequently, handling and/or operation of the auxiliary equipment may be performed with limited or even without interfering with the running of the tubular equipment through the well centre, i.e. away from the critical path of the drilling operation. Handling of auxiliary equipment may e.g. include preparation of suspendable auxiliary equipment such as sensors, robots, drones that are to be lowered into the drilled well at a later point in time. The offshore drilling rig may thus be configured, during all movement of tubular equipment to the first well centre, to keep the first open drill floor deck area free of said tubular equipment being moved to the first well centre. In particular, in some embodiments, the first open drill floor deck area is not occupied and/or cannot be occupied by neither a horizontal pipe handling equipment or by vertical pipe handling equipment. In particular, the open drill floor deck areas are free of any rails, guides or skid beams of the catwalk machine or other tubular feeding machines. Handling of auxiliary equipment may further be performed in a safe manner sufficiently remote from the normal drilling operation. An open drill floor deck area may even be sized and shaped to allow on-deck auxiliary equipment to be fixedly installed, i.e. during the entire drilling operation or at least stages thereof.

To this end, the first open drill floor deck area may be larger than 1 m in both directions (e.g. 1 m by 1 m or 1 m by 5 m), such as larger than 2 m in both directions, such as larger than 3 m in both directions, such as larger than 4 m in both directions, such as more than 5 m in both directions. In some embodiments, the first open drill floor deck area may be at least 4 $m^2$ large, e.g. at least 10 $m^2$, e.g. at least 15 $m^2$, e.g. at least 25 $m^2$, e.g. at least 35 $m^2$, e.g. at least 50 $m^2$, e.g. at least 65 $m^2$, e.g. at least 80 $m^2$, 100 $m^2$ large, e.g. at least 200 $m^2$, such as at least 500 $m^2$, such as at least 1000 $m^2$, such as at least 2000 $m^2$, e.g. at least 5000 $m^2$. The open drill floor deck area may cover at least a sector of a circle around the well centre having a radius of at least 2 m, such as 3 m, such as 4 m, such as 5 m, such as 6 m, such as 8 m, such as 9 m, such as 10 m, such as 15 m, such as 20 m, such as 30 m, the sector having a central angle of at least 50°, such as at least 60°, such as at least 90°, e.g. at least 120°, e.g. at least 130°.

In some embodiments, one or more of the open drill floor deck areas are accessible with a crane, such as a knuckle boom crane, so that relatively large equipment may be lifted on or off the open drill floor deck area. In some embodiments, the drilling rig comprises such a crane. Such equipment may be auxiliary equipment as discussed below.

In some embodiments, the open drill floor deck area has a free height of at least 3 m, such as at least 5 m, such as at least 10 m, such as at least 20 m, e.g. at least 30 m.

The term open drill floor deck area is intended to refer to a part of the drill floor deck that is free of pipe handling equipment, at least fixedly installed pipe handling equipment, during normal drilling operation such as drilling, making and breaking stands, running and tripping tubulars. Pipe handling equipment refers to equipment for drilling, making and breaking stands, running and tripping tubulars. The term normal drilling operation is further intended to refer to operations other than exceptional operations such as repair, maintenance work, or the like. The term fixedly installed equipment is intended to refer to equipment that is not movable during normal operation of the drilling rig, e.g. not skiddable or otherwise displacable. In some embodiments, the open drill floor deck area is further free of coiled tubing equipment, at least fixedly installed coiled tubing equipment, during normal drilling operation. In some embodiments, the open drill floor deck area is further free of heavy subsea equipment during normal drilling operation. Here the term subsea equipment refers to equipment such as blow out preventers or Christmas trees or similar assembly of valves, spools, and fittings that are installed under the drilling rig during the drilling operation. In some embodiments, the open drill floor deck area is not used during normal drilling operation for moving tubular equipment, coiled tubing and/or heavy subsea equipment to/from the well centre.

When the first open drill floor deck area comprises an access path to the first well centre, which access path extends outside the footprint of the first mast, auxiliary equipment may easily be moved to/from the first well centre. The access path may allow free access from the entire first open drill floor deck area to the first well centre without entering the footprint of the mast. The access path may provide a free height of at least 3 m, such as at least 5 m, such as at least 7 m such as at least 10 m, such as at least 15 m, such as at least 20 m thus allowing even tall items to be moved. For example, while the open drill floor deck area is generally free of pipe handling equipment during normal drilling operations, in certain exceptional situations it may be desirable to move tubular equipment such as risers to the open drill floor deck area, e.g. for repair or maintenance work. Such operations may thus be performed conveniently and safely without interfering with the normal drilling operation. When the access path is a straight path, e.g. extending in the longitudinal or transverse direction, particularly convenient access is provided. Similarly, when the access path is short, e.g. less than 20 m such as less than 10 m, efficient access is provided. When the access path is wide enough to allow vehicles such as forklifts and/or skiddable items moving along skid beams to move between the open drill floor deck area and the well centre, the efficiency of the drilling rig is increased. For example, the access path may be at least 2 m wide, such as at least 3 m e.g. at least 5 m wide.

In some embodiments, the drilling rig comprises access paths to the well centre from two, three or even from all four sides, i.e. from both longitudinal directions and from both transverse directions.

In some embodiments, the drilling rig comprises a guard structure configured to prevent tubular equipment operated above the first well centre from falling onto the drill floor deck area in a direction away from the first mast. The guard structure may be configured to guard at least part of (such as all of) the first open drill floor deck area from such falling tubular equipment. The guard structure may be a lateral guard structure extending, e.g. along the longitudinal direction, between support structures located on respective sides of the first well centre; one of the support structures may be the first mast. Consequently, even during ongoing drilling operations, auxiliary equipment may be handled and/or placed safely within the first open drill floor deck area. The guard structure may be formed completely or partially from one or more beams, chains, or similar structures; it may be located at a suitable elevation above the drill floor deck, low enough to allow tubular equipment to be caught and in some embodiments high enough to allow auxiliary equipment to be moved underneath. In some embodiments, the guard structure may comprise guards arranged at respective heights and/or guards that are movable between respective heights e.g. to allow catching of tubular equipment of various length such as pipes and stands. For example, the guard structure may be elevated above the drill floor deck at least 2 m, such as at least 3 m, such as at least 5 m, such as at least 7 m, such as at least 10 m, such as at least 15 m, such as at least 20 m, such as at least 30 m, such as at least 40 m; the guard structure may be elevated less than 30 m, such as less than 25 m, such as less than 20 m, such as less than 15 m, such as less than 10 m, such as less than 7 m, such as less than 5 m, such as less than 3 m. In embodiments, where the drilling rig comprises a pipe storage structure on a second side of the first well centre opposite the first side where the mast is located, the guard structure may extend between and be connected to the first mast and the pipe storage structure.

In some embodiments, the guard structure may be movable between a closed position where it prevents tubular equipment operated above the first well centre from falling onto the first open drill floor deck area and an open position where it allows increased lateral access, e.g. without height restriction, to the first well centre from the area which it is configured to guard. For example, the guard structure may be hinged or horizontally or vertically slidable. As noted above, the guard structure may comprise parts at various heights, some or all of which may be opened. Also, it may be desirable to move the guard structure during use of a support structure as described herein. Alternatively or additionally, the guard structure may be operable to be moved to different elevations.

In some embodiments, an offshore drilling rig comprises a gantry structure or another suitable mounting structure for suspending suspendable auxiliary equipment from an elevated position above the drill floor deck, allowing the auxiliary equipment to be lowered or hoisted through the first well centre; wherein the mounting structure is movable between a lower position for rigging up auxiliary equipment to the mounting structure, and an elevated position allowing lowering or hoisting of auxiliary equipment suspended from the mounting structure through the first well centre.

In some embodiments, the mounting structure may extend along the longitudinal direction from a first mast that is longitudinally displaced from the well centre as described herein. The mounting structure may comprise devices, such as one or more hooks, sheaves, pulleys, guide members such as guide arches, and/or one or more other connection mechanisms and/or devices for supporting cables or wires or coiled tubing for on-deck connecting auxiliary equipment positioned on the drill floor deck, e.g. on the open drill floor deck areas with suspendable auxiliary equipment such as downhole tools to be advanced towards the seafloor. The mounting structure is different from the hoisting system and preferably operable independently of the hoisting system.

It will be appreciated that a mounting structure as described herein may be used in combination with various embodiments of a drilling rig comprising a drill floor deck having a hole defining a first well centre; a first mast upwardly extending relative to the drill floor deck, and a first hoisting system supported by the first mast and configured for hoisting and lowering tubular equipment through the first well centre.

Consequently, suspendable auxiliary equipment to be lowered through the well centre may conveniently, efficiently and safely be prepared, rigged up and brought into an operational position without the need for human operators climbing at unsafe heights. In particular, when the mounting structure is in its lower position, a connection mechanism of the mounting structure for connecting auxiliary equipment to the mounting structure is made conveniently accessible to human operators from the drill floor deck; for example, the lower position may be no more than 3 m, such as no more than 2.5 m above drill floor deck, such as no more than 2 m, such as no more than 1.5 m. The elevated position may be at least, 3 m, 5 m, or 10 m above the drill floor deck, such as at least 15 m above the drill floor deck, e.g. at least 20 m above the drill floor deck, e.g. at least 30 m above the drill floor deck, e.g. at least 40 m above the drill floor deck.

When the mounting structure is arranged horizontally displaced from the well centre (in the longitudinal and/or transverse direction), e.g. connected to one of the corners or sides of the mast facing the open drill floor deck area, the preparation of the auxiliary equipment and its connection to the mounting structure may conveniently be performed from the first open drill floor deck area without or at least with minimal interference with any ongoing drilling operation. In some embodiments, the horizontal displacement is more than 0.5 m, such as more than 1 m, such as more than 2 m, such as more than 3 m, such as more than 4 m, such as more than 5 m, such as more than 6 m, such as more than 7 m, such as more than 10 m, such as more than 15 m, such as more than 20 m; at the same time less than 100 m, such a less than 75 m, such as less than 50 m, such as less than 25 m, such as less than 15 m, such as less than 10 m, such as less than 7 m, such as less than 5 m, such as less than 3 m, such as less than 2 m, such as less than 7 m. In some embodiments, the height of the support structure and the horizontal displacement from the well centre are arranged to allow a suitable angle and/or bend radius for suspended wire connecting the suspendable auxiliary equipment through the well centre. To this end, in some embodiments, the first open drill floor deck area allows a spacing of any on-deck auxiliary equipment, such as reels of spooled wire or coiled tubing or other on-deck components supporting the suspendable auxiliary equipment, from the support structure (measured on the drill floor deck) of more than 1 m, such as more than 2 m, such as more than 3 m, such as more than 4 m, such as more than 5 m, such as more than 6 m, such as more than 7 m, such as more than 10 m, such as more than 15 m, such as more than 20 m.

The mounting structure may e.g. comprise a beam or similar elongated structure that may be slidably arranged on rails or tracks on the mast and on a corresponding structure, e.g. a pipe storage structure, on a second side of the well centre opposite the first side where the mast is located. The mounting structure may be part of or separate from a guard structure as described herein.

The drilling rig may further comprise a pipe storage structure, e.g. providing a setback area for storing assembled stands of pipes, positioned on a second side of the first well centre opposite the first side. Again, this pipe storage structure may be located at the same level as the drill floor deck or at least partially at a different level, e.g. a lower level so as to allow tubulars to be advanced along a sloping direction.

When the first open drill floor deck area extends around the setback area to a side of the setback area distal from the first well centre, movable equipment may be moved around the first open drill floor deck area and around the setback area from one lateral side of the well centre to the other side without interfering with the drilling operation.

In some embodiments, the drilling rig is a dual (or even multiple) activity rig where more than one main or auxiliary drilling operations may be performed through two or even more separate work centres, one, some or all of which may be well centres. In some embodiments, in addition to a well centre for performing primary drilling operations, an additional work centre may be a hole in the drill floor through which tubulars may be lowered but through which tubulars may not necessarily be lowered all the way to the seabed. Such a work centre may even comprise a bottom which prevents tubulars from inadvertently fall to the seabed. Alternatively or additionally, one or more additional work centres may be well centres as described above. To this end, in some embodiments, the offshore drilling rig further comprises a second work centre such as a second well centre displaced from the first well centre, optionally a second mast upwardly extending relative to the drill floor deck, and a second hoisting system supported by the second mast and configured for hoisting and lowering tubular equipment through the second work centre.

In some embodiments, the positions of the first well centre and the second work centre together define a transverse direction within the plane of the drill floor deck; the first and second masts may be arranged side by side in the transverse direction or in another suitable configuration. The two masts may be integrated into one mast.

In some embodiments, the position of the second work centre is place substantially along the longitudinal direction; the first and second masts may be arranged opposite each other, e.g. in a face-to-face or a back-to-back configuration.

Hence, efficient dual (or even multiple) drilling activities may be carried out, and drilling crew and equipment may conveniently be moved between the well centres. Furthermore, operations at both the first well centre and the second work centre may conveniently be monitored and/or controlled, e.g. from a single driller's cabin having a direct line of sight to both the first well centre and the second work centre. Moreover, the first well centre and the second work centre may be used as back-up/replacement for each other in a convenient manner, because storage areas, pipe handling equipment etc. serving both the first well centre and the second work centre may be arranged to efficiently serve/cooperate with both the first well centre and the second work centre. This is particularly the case when the second work centre is operable as a well centre. It will be appreciated that, during operation of embodiments of a drilling rig with two (or more) well centres, not all well centres may necessarily be capable of simultaneously accessing the same bore well.

In some embodiments, the drilling rig comprises a guard structure extending between the first well centre and the second work centre, e.g. a second well centre, and configured to prevent tubular equipment operated above the first well centre from falling onto the second work centre. The guard structure may be a lateral guard structure extending in a direction transverse to the direction connecting the first well centre and the second work centre between support structures located on respective sides of the first well centre and the second work centre; one of the support structures may be the mast. In some embodiments, the guard structure may be configured to be brought into a retracted configuration allowing tubulars to be transferred between the first well centre and the second work centre. For example, the guard structure may have the form of a dividing barrier structure such as a wall, fence or curtain that may be rolled up around a horizontal or vertical axis or otherwise brought into a compacted, inactive configuration. The guard structure may have a height corresponding to the length of the largest tubulars handled by the drilling rig, e.g. at least 50% such as at least 75% such as at least 100% of the height of the largest tubulars. It will be appreciated that such a guard structure may be implemented on any drilling rig having two or more hoisting systems and work centres.

The capacity of the equipment related to the first well centre and the second work centre, e.g. the respective masts, parts of a common mast, hoisting systems, etc., may be different e.g. they may have different hoist capacity, or they may have equal hoist capacity and/or be otherwise identical or at least interchangeably usable for drilling operations. The equipment related to the second work centre may comprise and/or cooperate with the same or corresponding features, elements, components or devices already discussed in connection with the first mast and/or the first well centre. For example, the second mast may comprise or cooperate with a guard structure and/or a mounting structure as described herein. The first and second masts may be separate structures or combined as a single mast structure. For example, the first and second masts may be embodied as a combined mast supporting first and second hoisting systems.

The term main drilling operation is intended to refer to the actual drilling operation where the drill string is advanced through a riser to and into the sea floor. Auxiliary drilling operations may include the building up of stands of tubulars, advancing of tubular equipment towards or to the sea floor, drilling of a top hole, and or the like. Accordingly, the drilling rig is configured to advance risers to the seafloor through at least the first well centre, and the drilling rig comprises a diverter located under the drill floor deck at the first well centre. In some embodiments, the drilling rig is configured to allow drilling operations to be performed through both well centres, i.e. both well centres, masts, and hoisting systems may be configured to allow risers and the drill string to be advanced all the way to the seabed. In some embodiments, the second mast and/or the second hoisting system may be configured to operate as an auxiliary system, e.g. for running risers, building stands, and or the like. In some embodiments, the second hoisting system may have a different, e.g. smaller, hoist capacity as the first hoisting system. Nevertheless, even in such embodiments, the second mast, hoisting system and well centre may be suitable for taking over the primary drilling operation, e.g. in situations when the first mast, hoisting system or well centre is out of order. In other words, any of the features above discussed in relation to the first well centre may further be arranged in relation to the second well centre, as a combined feature for both well centres or a feature in relation to the second well centre alone.

In some embodiments, the offshore drilling rig thus comprises pipe handling equipment for feeding tubular equipment towards the first well centre and pipe handling equipment for feeding tubular equipment towards the second work centre, e.g. a second well centre; each or both of the pipe handling equipment defines a respective pipe feeding path, e.g. substantially along the longitudinal direction, across the transverse direction, along which pipe feeding path tubular equipment is moved towards the first well centre and the second work centre, respectively. In some embodiments, tubular equipment may be moved in parallel to both the first well centre and the second work centre. In some embodiments, the tubulars may be moved from a common storage structure such as when tubular equipment are moved to the well/work centres from the same side. This allows for a more efficient operation of the rig, and providing a higher degree of flexibility and redundancy of critical components. Some embodiments of the offshore drilling rig comprise a pipe storage structure positioned longitudinally displaced from the first well centre on a second side of the well centre, opposite the first side and laterally positioned between the respective pipe feeding paths.

In some embodiments, the drilling rig may comprise two diverter housings, one positioned under each well centre.

As noted above, any feature discussed in relation to the first well centre may be present in relation to the second work centre, including an open drill floor deck are—referred to as a second open drill floor deck area. In some embodiments, the drill floor deck comprises at least a first open drill floor deck area located adjacent to the first mast in the transverse direction on a side opposite the second work centre, and a second open drill floor deck area located adjacent to the second mast in the transverse direction on a side opposite the first well centre. The first and second drill floor deck areas are thus areas other than the drill floor deck area between the first well centre and the second work centre and other than any drill floor deck area used for movement of tubular equipment to the first well centre. Consequently, open drill floor deck areas are provided on both transverse sides of the well/work centres, thus further increasing the flexibility and efficiency of the rig, as auxiliary equipment may be stored and/or handled on both sides of the mast and moved to/from both well/work centres without interfering with the drilling operation at the other well/work centre. In particular, in some embodiments, the drilling rig is configured to perform movement of tubular equipment to the first well centre and to the second work centre along respective first and second pipe feeding paths towards the respective first and second well centres which first and second pipe feeding paths only cross drill floor deck areas outside the first and second open drill floor deck areas.

When each of the first and second open drill floor deck areas comprises an access path extending outside the footprint of the first and second masts and along the transverse direction to the first well centre and the second work centre, auxiliary equipment may be moved directly between both open drill floor deck areas and the respective well/work centres.

When the first and second open drill floor deck areas are connected with each other by a connecting drill floor deck area, equipment may conveniently be moved between the open drill floor deck areas without interfering with the drilling operations. The connecting drill floor deck area may thus be shaped and sized so as to allow equipment to be moved between the open drill floor deck areas, e.g. by means of a forklift and/or on skid beams, without having to climb or descend onto different deck levels. For example, the connecting drill floor deck area may define a connecting path between the first and second open drill floor areas having a width of at least 2 m, such as at least 3 m, such as at least 5 m. In some embodiments, the connecting drill floor deck area extends around the pipe storage structure on a side of the pipe storage structure distal from the first well centre and the second work centres.

In some embodiments the drilling rig comprises a storage area for storing tubulars located below the level defined by the drill floor deck. The drill floor deck may thus extend above and partly or completely across the entire storage area. Tubulars may thus be stored such that both ends of each tubular are positioned below the drill floor deck level. In particular, in some embodiments the storage area is configured to receive tubulars in upright orientation such that an uppermost end of the tubulars is located below the drill floor deck level. The tubulars may be riser joints, stands of drill pipe, stands of casing, or other tubular members. The drilling rig may thus comprise pipe handling equipment for feeding tubulars from the storage area through an opening in the drill floor deck, different from the well and work centres, and for presenting the tubulars to the hoisting system, e.g. such that the upper end of a tubular member may be connected to a top drive, hook or similar connection device of the hoisting system and lifted through the opening in the drill floor and to suspend the tubular above the well centre. The opening may be a hole or cut-out in the drill floor. The pipe handling equipment may comprise an inclined chute for advancing riser joints and/or other types of tubulars such as stands or singles of drill pipe or casings. In some embodiments the chute may be configured to adjust its position and/or inclination while the riser joint or other tubular is advanced upwards through the opening in the drill floor so as to guide the riser joint or other tubular towards an increasingly upright orientation while the riser joint or other tubular is advanced upwards starting from an inclined position on the chute. Consequently, a particularly space-saving storage of tubulars is provided that further provides for a low centre of gravity of the structure. The storage area(s) may be located adjacent to the moon pool located below the well centres, such as on two opposite sides of the moon pool.

In some embodiments, the drilling rig is arranged so that both riser joints and stands of drill-pipe and/or casings may be stored partly or completely below the drill floor.

The storage area below the drill floor deck level may be configured to store tubulars in upright and/or horizontal orientation.

For example, when the drilling rig is a drillship, the storage area below the drill floor deck may be configured for horizontal storage of tubulars, such as risers, forwards and/or aft of the moonpool. The rig may then be arranged to bring riser joints (or other tubulars) under the drill floor and rotate the riser joints in order for them to be presented via the hole in the drill floor. This rotation may take place above the larger moonpool area. The function of rotation of the riser (or other tubular) may be performed by one of the embodiments described in co-pending Danish patent application PA 2013 70602.

The hole is preferably fitted with a hatch so that the hatch can be utilized as floor when the hatch is closed and the hole is not in use.

In some embodiments, the drilling rig comprises a stand building and/or setback area (preferably a lowered setback) on a side of the mast, opposite the well centre;

Generally, according to one aspect, disclosed herein are embodiments of an offshore drilling rig comprising:

- a drill floor deck having a hole defining a first well centre;
- a first mast upwardly extending relative to the drill floor deck;
- a first hoisting system supported by the first mast and configured for hoisting and lowering tubular equipment through the first well centre; wherein the load bearing structure of the first hoisting system is displaced from and located on a first side of the first well centre;
- first pipe handling equipment for moving tubular equipment to the first hoisting system so as to allow the first hoisting system to hoist or lower the tubular equipment through the first well centre;
- a storage structure such as a setback for storing tubulars chosen from drill pipes, casings, stands of drill pipes and stands of casings, located on the first side of the well centre; at least partly underneath the drill floor deck and/or at least partly behind the load bearing structure when seen from the first well centre.

For example, this may be advantageous where two well centres are arranged adjacent a dual-activity mast in a side-by-side configuration where tubulars may be moved from the setback to both well centres. In combination with a gap formed in the hoisting system, e.g. between groups of the hoisting cylinders, that allows stands to be presented to the hoisting system, an open drill floor is achievable (see e.g. FIG. 15).

In some embodiments the drilling rig comprises a stand building and/or setback area (preferably a lowered setback) adjacent to the mast and behind the driller's cabin, such as on the opposite side of the drillers cabin relative to the well centre(s). Examples of this are illustrated in FIGS. 14-21.

Alternatively, the drilling rig may comprise a stand building and/or setback area on one of the transverse sides of the well centre; for example, this may be advantageous where two well centres are arranged between two masts or mast portions arranged in a face-to-face configuration.

Stand-building equipment may be operable to assemble stands of drill pipes and/or casings, e.g. comprising two, three or more drill pipes. Such stand-building equipment may be dedicated stand-building equipment which is not operable to lower tubulars to the seabed. Stand-building equipment may be located at least partly below the drill floor deck.

In some embodiments, the drilling rig comprises vertical pipe handling equipment for feeding tubulars to said stand building setup. The vertical pipe handling equipment may be arranged to bring pipes stored forward and/or aft of the drill floor to the stand building setup without intersection the drill floor. The setback area may be lowered relatively to the drill floor deck.

In some embodiments, the first hoisting system comprises a plurality of upright cylinders upwardly extending from a position adjacent the first well centre, and a top drive operable to lower tubulars through the first well centre; and wherein the drilling rig further comprises pipe handling equipment operable to present stands and/or singles of casing or drill pipe from a setback area on a side of the cylinders, opposite the well centre, to the top drive via a gap formed between two groups of cylinders, such as via cut-out in the drill deck as discussed above.

BRIEF DESCRIPTION OF THE DRAWINGS

The above and/or additional objects, features and advantages of embodiments and aspects of the present invention, will be further elucidated by the following illustrative and non-limiting detailed description with reference to the appended drawings, wherein:

FIGS. 1-8 illustrate views of an embodiment of an off-shore drilling rig wherein FIG. 1 shows a 3D view of the drilling rig, FIGS. 2-6 show 3D views of parts of the drilling rig from different viewpoints, FIG. 7 shows a cross-sectional view of the drilling rig in a longitudinal plane through the centre of the drilling rig, looking in the transverse direction, and FIG. 8 shows a top view of the drilling rig.

FIGS. 15-21 illustrate another embodiment of an offshore drilling rig, wherein FIGS. 15-16 show 3D views of parts of the drilling rig from different viewpoints, FIGS. 17-18 show horizontal cross-sectional views of the drilling rig, FIGS. 19-20 show lateral cross sections of the drilling rig, and FIG. 21 shows another 3D view of the drill floor seen from the starboard side of the drillship.

DETAILED DESCRIPTION

Figure 1:
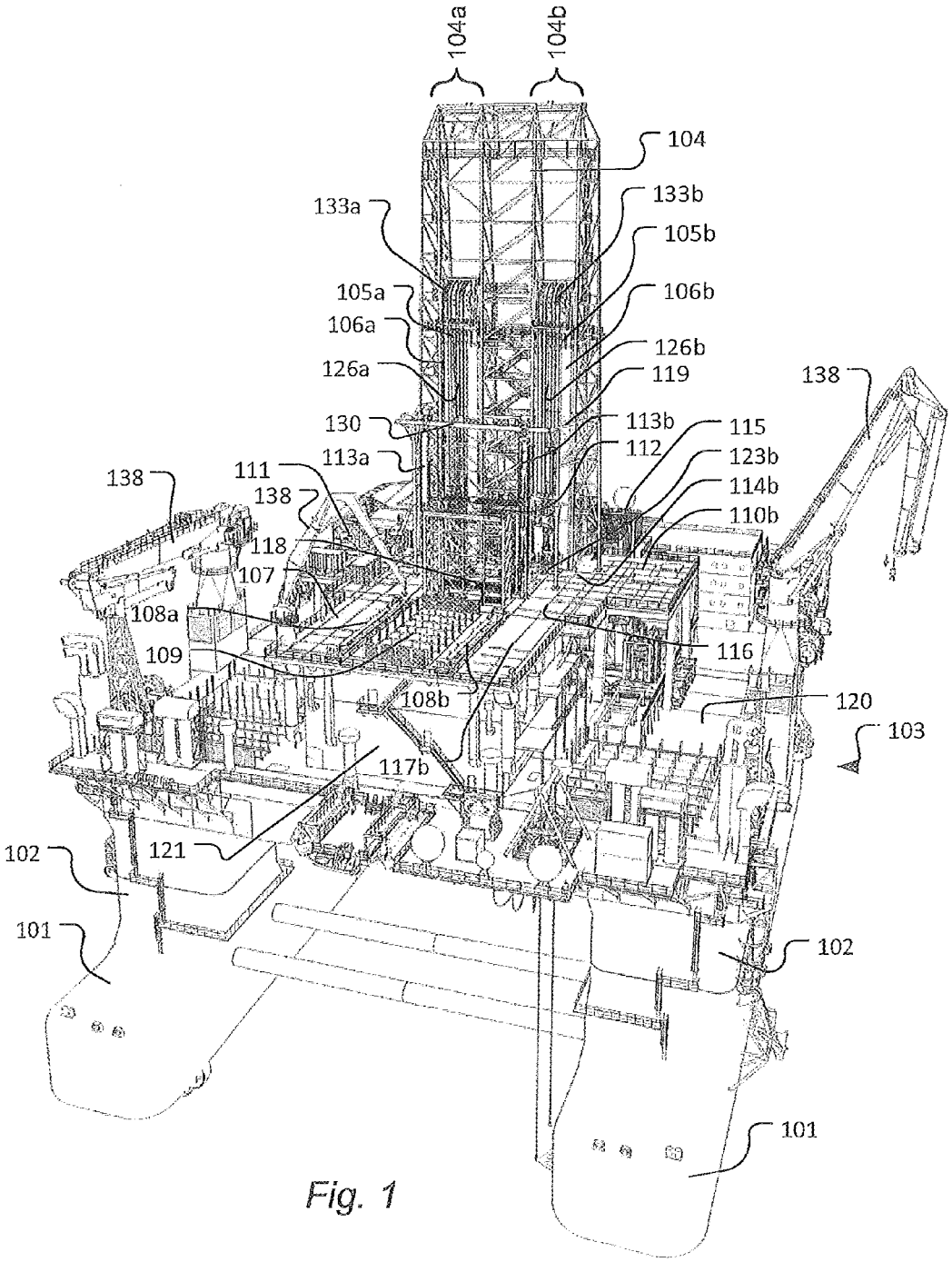

In the following description, reference is made to the accompanying figures, which show by way of illustration how the invention may be practiced.

An embodiment of an off-shore drilling rig will be described with reference to FIGS. 1-8.

The drilling rig is a semisubmersible drilling rig, comprising pontoons 101 from which support columns 102 extend upwardly, and a topside platform 103 supported by the columns 102. During operation, the drilling rig floats at the ocean surface with the pontoons 101 typically under the water and the support columns extending out of the water such that the topside platform is elevated above the water. To this end, the pontoons may be filled with ballast water so as to cause the rig to be submersed to the desired level.

The topside platform comprises a drill floor deck 107 arranged elevated from a main deck 120 and partly formed by the roof of an enclosure 121 accommodating mud mixing equipment and/or other equipment. The drill floor deck 107 comprises two holes defining well centres 123*a,b* located next to a dual activity mast 104. The dual activity mast 104 extends upwardly from the drill floor deck 107 and comprises two mast portions 104*a,b* arranged side by side in the transverse direction. The drilling rig comprises respective hydraulic hoisting systems 105*a,b*, each for lowering a drill string through a respective one of the well centres 123*a,b* towards the seabed. Each hydraulic hoisting system comprises cylinders 106*a,b*, respectively, that extend upwardly from the drill floor deck and support the load to be lowered or hoisted. Each mast portion is associated with one of the hoisting systems and stabilises the hoisting systems against lateral forces and/or against bending of support members carrying the weight of the sheaves and the load suspended from the hoisting system. Each well centre is located next to one of the mast portions and the corresponding hoisting system; both well centres are located on the same side relative to the mast. The position of each of the well centres relative to the corresponding hoisting system defines a longitudinal direction, in this example the longitudinal direction of the drilling rig, i.e. between bow and aft of the drilling rig. The well centres are arranged along a transverse direction, normal to the longitudinal direction, in this example the transverse direction (from port to starboard) of the drilling rig. The longitudinal and transverse directions are indicated by arrows 140 and 141, respectively, in FIG. 8.

The cylinders of each hoisting system are arranged in two groups that are positioned displaced from each other in the transverse direction so as to form a gap 126*a,b*, respectively, between the two groups. Each gap 126*a,b* is thus aligned with a respective one of the well centres along the longitudinal direction. Each gap extends upwardly along the entire length of the cylinders, thus allowing tubulars to be moved through the gap towards the respective well centre and even raised into an upright position while being located at least partly in the gap between the cylinders. The well centre is longitudinally displaced from the gap. Alternatively or additionally the cylinders or other support members may be positioned on a foundation elevated above the drill floor and the gap may at least partly be formed in the foundation. A gap may also be obtained in an alternative way or in combination with a gap between cylinders, as will be illustrated in combination with FIGS. 22-24 below. The rods of the cylinders support sheaves 133*a,b*, respectively, of a travelling yoke over which the hoisting wires are suspended. One end of the hoisting wires is anchored to the drilling rig, while the other end is connected to top drive 137*a,b* or hook of the corresponding hoisting system. The sheaves 133*a,b* are laterally supported and guided by the respective mast portions. The axis of the sheaves extends in the transverse direction between two groups of cylinders, i.e. between support members for bearing the weight of the sheave(s).

The side-by-side configuration of the dual activity mast and well centres allows efficient dual operations, easy access to both well centres, and convenient visual control of both well centres from a single driller's cabin 134 which may e.g. be positioned transversely between the well centres, e.g. within the footprint of the mast.

The drilling rig comprises a setback structure 112 or similar pipe storage structure for storing stands of tubulars located on the other side (seen in longitudinal direction) of the well centres, opposite the mast. The setback structure comprises a support framework supporting fingerboards having horizontally extending fingers between which tubulars may be stored. The setback structure is arranged transversely between the transverse positions of the well centres so as to allow stands to be moved to/from both well centres from/to the setback. To this end, two column rackers 113*a,b* or similar vertical pipe handling equipment are arranged to move stands into and out of the setback structure 112. The column rackers are operable to move along the transverse direction along a support beam 130 spanning the transverse distance between the well centres. The support beam may be a part of the setback support framework. The setback structure 112 may extend downwards to a deck below the drill floor deck so as to allow stands assembled from multiple pipes to be stored and moved to a respective one of the well centres. The setback structure may comprise a foxhole and separate or integrated stand-building equipment, thus allowing stands of pipes to be assembled and stored without interfering with operations at the well centres. Alternatively or additionally, one of the hoisting systems and well centres, e.g. well centre 123*a,b* may be utilised for building stands.

A pipe storage area 109 for storing pipes in horizontal orientation is located behind the setback structure, seen from the well centres. On either transverse side of the pipe storage area respective catwalk machines 108*a,b*, or similar horizontal pipe handling equipment, are located extending in longitudinal direction, each aligned with one of the well centres, i.e. such that the horizontal pipe handling equipment defines a longitudinal axis that intersects with one of the well centres. Each catwalk machine is operable to move pipes from the storage area 109 to the corresponding well centre and hoisting system. To this end, the pipes may be placed on the catwalk machine by a crane, e.g. one of the knuckleboom cranes 138, and the catwalk machine may be longitudinally moved to the corresponding well centre, e.g. on skid beams or tracks 139*a,b* defining a straight pipe feeding path to the corresponding well centre. Hence, the catwalk machines move tubular equipment along the corresponding pipe feeding paths 139*a,b* towards the corresponding well centre. The catwalk machines and tracks 139*a,b* thus define longitudinal pipe feeding paths, each intersection with one of the well centres. The pipe feeding paths 139*a,b* extend towards the well centres from a side of the well centres opposite the side on which the mast is located. The column rackers 113*a,b* may be transversely moved to a position on the pipe feeding path, i.e. in longitudinal extension of one of the catwalk machines. In this position, the column racker may thus receive a pipe from the catwalk machine and, in cooperation with the catwalk machine, bring the pipe in a vertical position.

The drilling rig comprises another storage area 115 on the other side of the mast, i.e. on the side opposite the well centres. This storage area is located at a lower deck than the drill floor deck, and it is used for storing marine riser joints (also simply referred to as risers) in a vertical orientation. The risers may then be moved, e.g. by means of a gantry crane 136 and respective chutes 132*a,b* or other suitable pipe feeding equipment to the respective well centres. As the risers may be moved through the gaps 126*a,b* between the cylinders 106*a,b* of the hoisting systems, the risers may be moved directly from the riser storage area 115 to the well centre in a space efficient manner.

In this example, as all tubulars are moved to the well centres from opposite sides of the well centres along the longitudinal direction, and since the setback structure 112 and the storage area 115 are located longitudinally displaced from the well centres, the drill floor deck 107 comprises large open drill floor deck areas 110*a,b* on both lateral sides of the mast and well centres. These open drill floor deck areas are not occupied by pipe handling equipment, and all pipe movements between the storage/setback areas 112, 115 and the well centres 123*a,b* are performed along the longitudinal direction. The pipe feeding paths along which the pipes and other tubulars are moved to/from the well centres do not cross the lateral open drill floor deck areas 110*a,b*. Consequently, these areas may be used as working area, e.g. for rigging up suspendable auxiliary equipment such as coiled tubing, and/or for positioning on-deck auxiliary equipment 111. In the example of FIGS. 1-8, the open drill floor deck area 110*a* is used for placing and/or moving on-deck auxiliary equipment and/or for handling and/or operating such auxiliary equipment while at the same time allowing efficient and safe access to the well centre. Open drill floor deck area 110*b* is kept free of any pipe handling equipment and any other permanently installed equipment; this area may thus be used as a working area and/or intermediate storage area. Both open drill floor deck areas 110*a,b* are connected with the well centres by direct, straight access paths 114*a,b*, respectively, thus allowing equipment to be conveniently moved between the open drill floor deck areas 110*a,b* and the well centres, e.g. on skid beams 116. Any work within open drill floor deck areas 110*a,b* does not interfere with pipe movements to/from the well centres or with other operations at the well centres.

The well centres are placed outside the footprint of the mast and longitudinally displaced relative to the cylinders 106*a,b*, and the access paths are not blocked by any other fixedly installed structures on the drill floor deck or structures elevated at a low height above the drill floor deck. Thus, convenient access between the open drill floor deck areas 110*a,b* and the well centres is provided.

The open drill floor deck areas even extend laterally along the catwalk machines, thus allowing equipment to be moved along the catwalk machines and/or stored on open drill floor deck areas 117*a,b* extending along each of the catwalk machines. In particular, as the catwalk machines are located on the drill floor deck and as the drill floor deck comprises a large floor area extending along the catwalk machines, crew members may work with or at the catwalk machines without any (or at least with reduced) danger of falling. The parts 117*a,b* of the open drill floor deck area extending along the catwalk machines are large enough to allow skid beams to be installed, thus allowing equipment to be moved away from the lateral open drill floor deck areas 110*a,b*.

The lateral open drill floor deck areas 110*a,b* are even connected with each other by a connecting drill floor deck area 118, in this example a straight path of open drill floor deck area extending between the setback structure 112 and the pipe storage area 109. The connecting drill floor deck area 118 forms a path wide enough for skid beams to be installed or a fork lift to move along, thus allowing equipment to be conveniently moved from one of the lateral open drill floor deck areas 110*a,b* to the other, without having to traverse the well centres.

Figure 2:
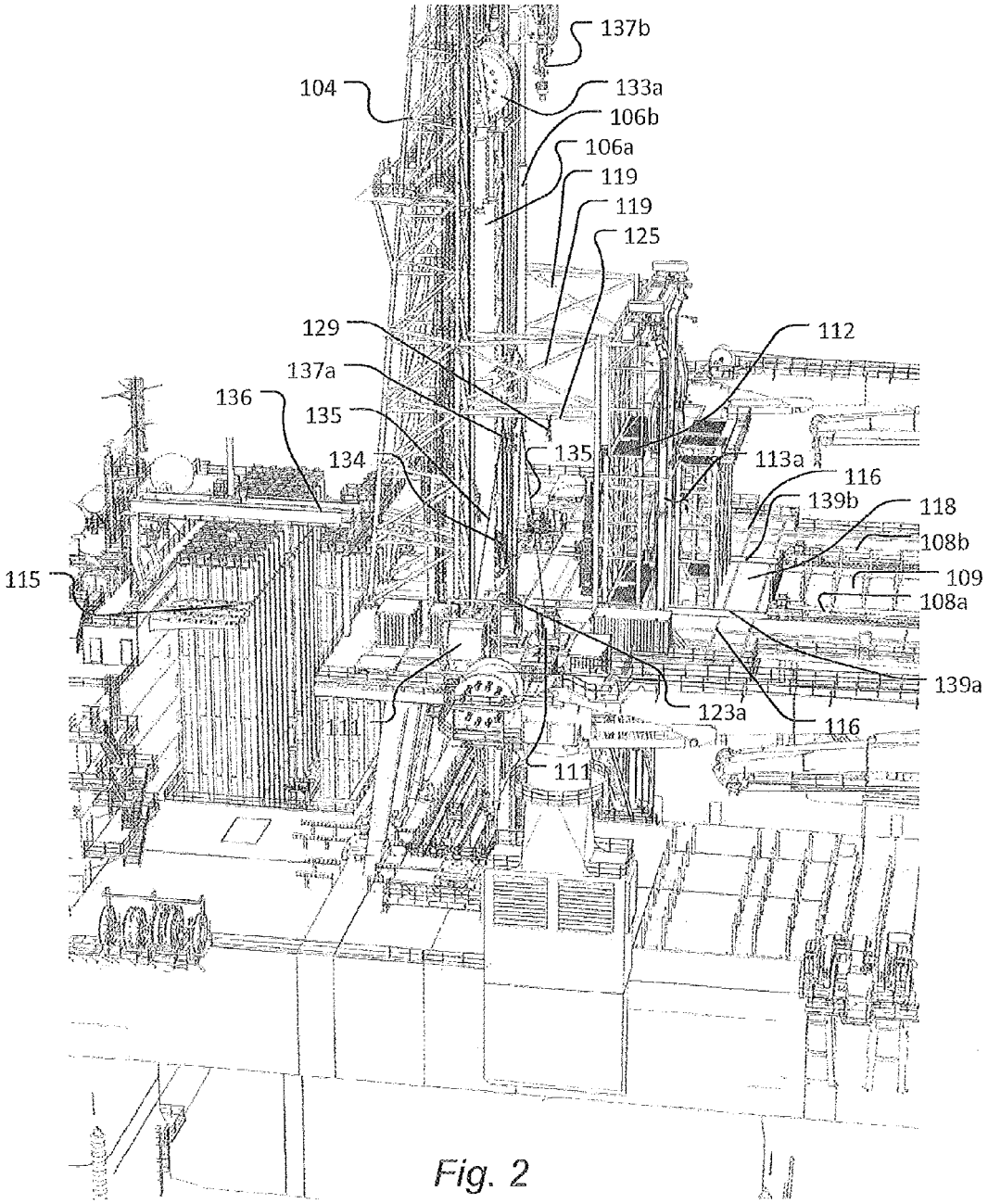
Figure 3:
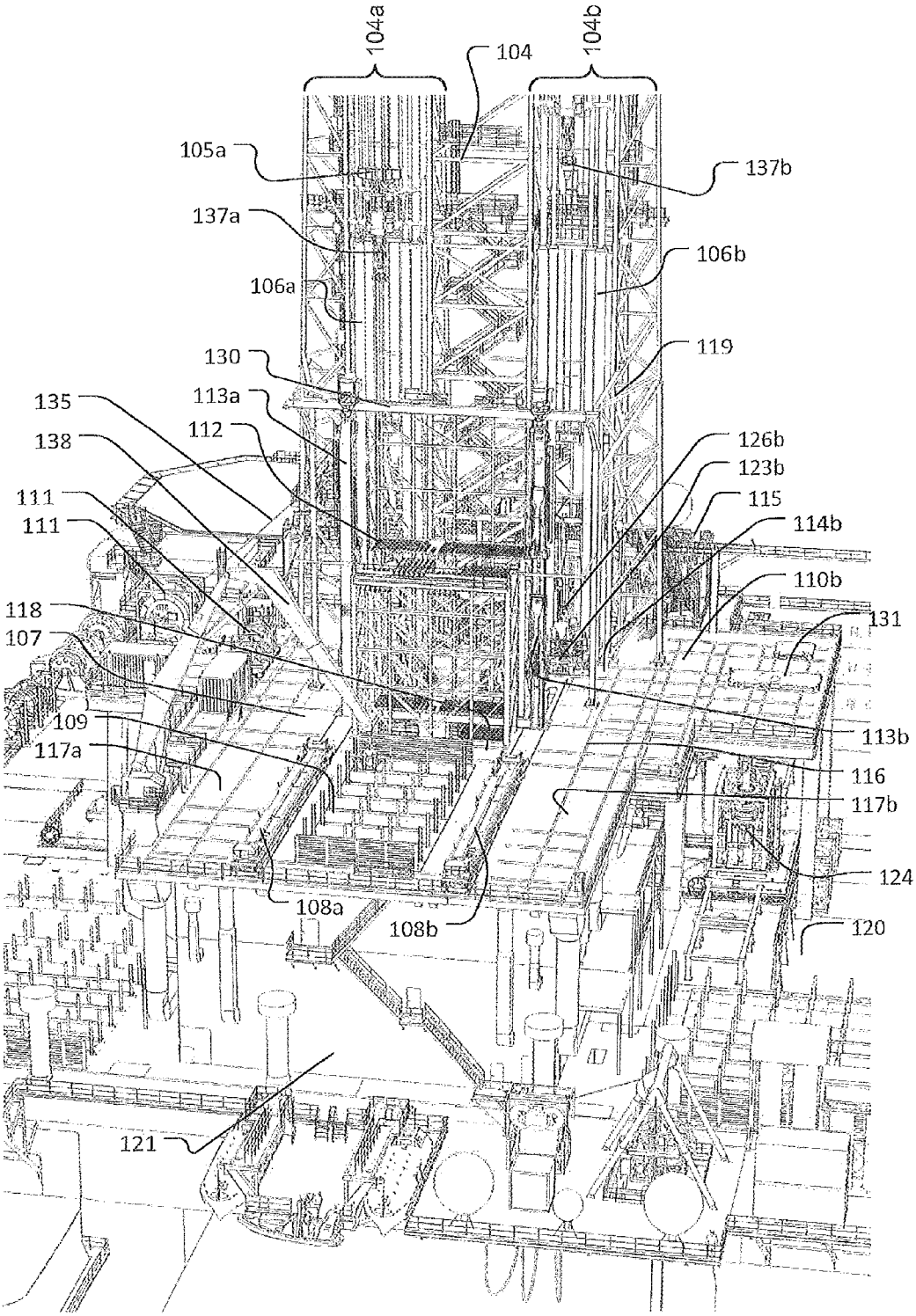
Figure 4:
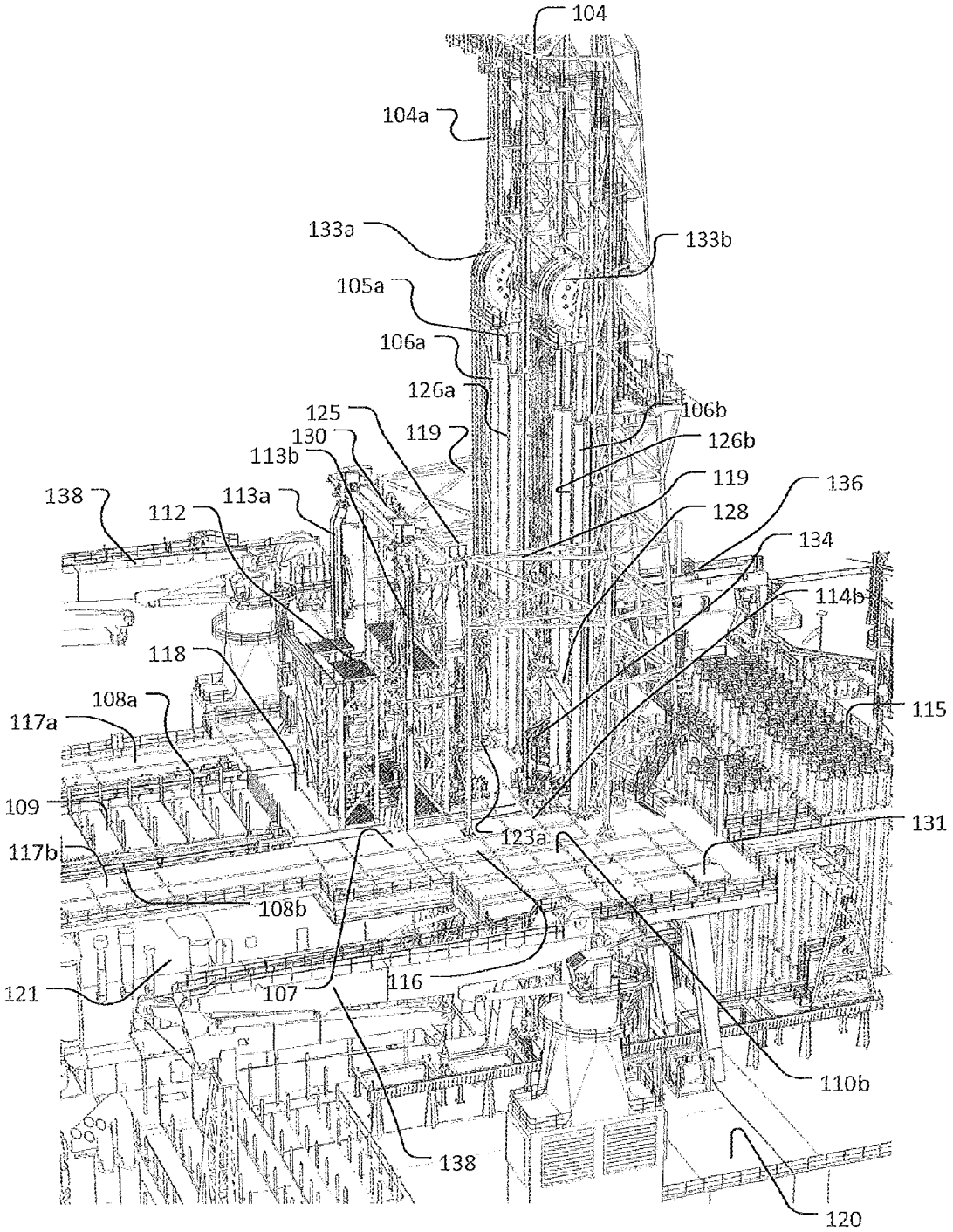

As is most easily seen in FIGS. 2 and 4, the drilling rig comprises guard structures 119 that extend in the longitudinal direction from respective lateral sides of the mast 104 to the support framework of the setback structure 112. It will be appreciated, however, that the guard structures 119 may be supported by a separate support structure. The guard structures span across the access paths 114*a,b* between the well centres and the respective open drill floor deck areas 110*a,b* at a height high enough to allow equipment to be moved under the guard structures. For example, the access paths 114*a,b* may have a free height of at least 10 m, such as at least 20 m, thus allowing even tall items to be moved. The guard structures are further located at a height above the drill floor deck that is suitable for preventing tubulars run through one of the well centres from falling on the open drill floor deck areas 110*a,b*. Consequently, equipment stored or even crew members working in one of the open drill floor deck areas 110*a,b* are protected against falling tubular equipment. In some embodiments, the height at which the guard structures are arranged may be adjustable. For example, the guard structures may be mounted to rails or tracks extending upwardly along the support structures to which the guard structures are mounted. The guard structures may then be lifted by wires or cables, by a hydraulic mechanism, or by another suitable hoisting mechanism. Hence, the guard structures may be positioned at different heights in accordance with the length of the tubular equipment run. Alternatively, the guard structure may be formed as a plurality of separate structures that are arranged at different heights and/or whose height can be individually adjusted. In yet another embodiment the guard structures may be operable to be opened so as to allow unobstructed access to the well centre, even for equipment having a large height. For example, defective tubulars may need to be placed within one of the open drill floor deck areas 110*a,b*, so as to allow maintenance or repair of the defective equipment while the drilling operation continues. The guard structures may be opened in a number of different ways. For example, they may be hinged at one side or at both sides, or they may be slidable to a large height. The inventors have realised that such a guard structure may also be implemented in combination with other types of mast structures, such as other guard structures providing an open drill floor deck.

Figure 5:
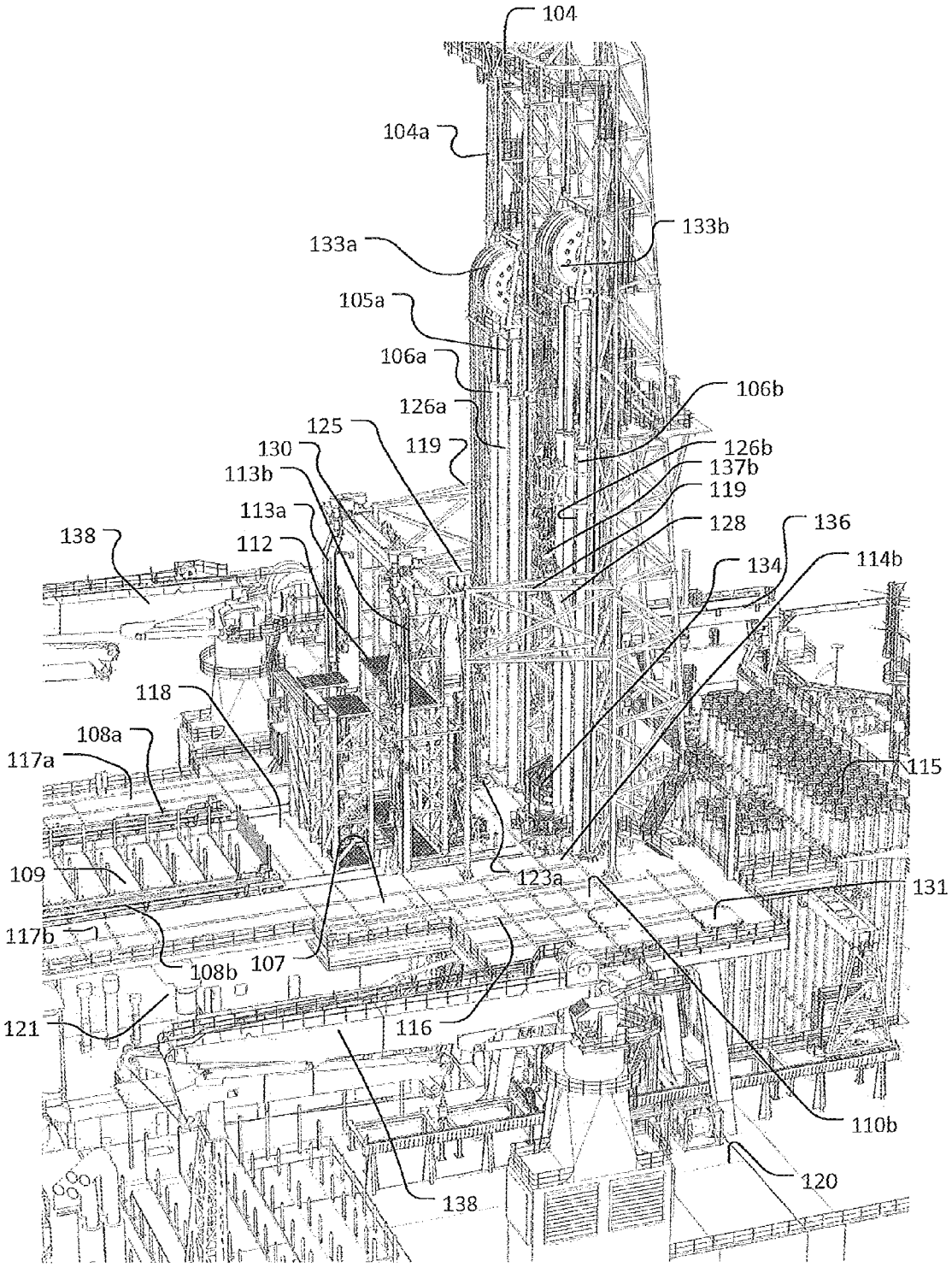
Figure 6:
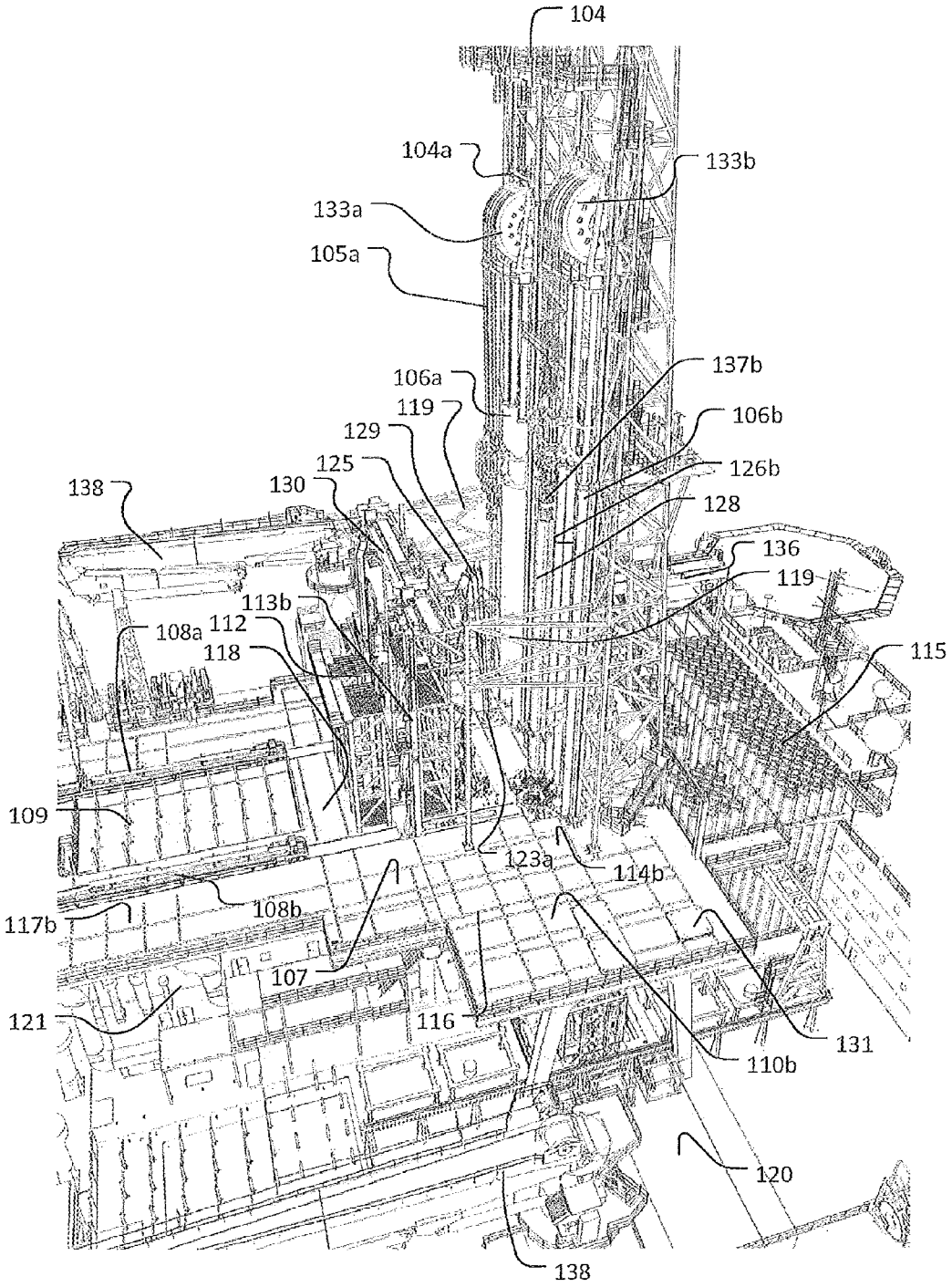
Figure 7:
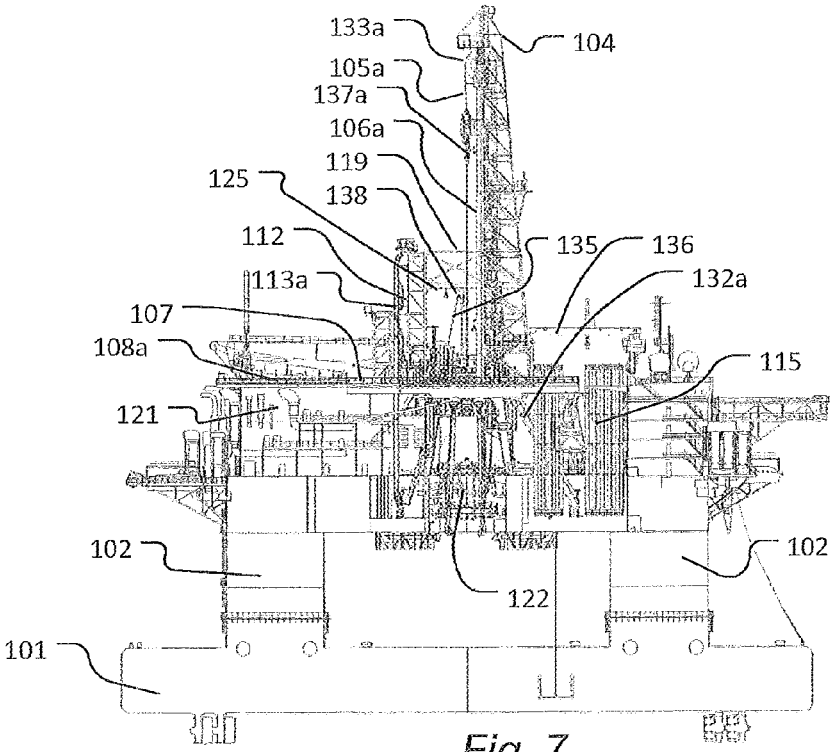

As is most easily seen in FIGS. 2 and 6, the drilling rig further comprises a gantry beam or framework 125 or a similar mounting structure for suspending suspendable auxiliary equipment from an elevated position above the drill floor deck, allowing the auxiliary equipment to be lowered or hoisted through the first well centre. The gantry beam 125 is connected to respective support structures on both longitudinal sides of the well centres and laterally displaced from the well centre. In this particular embodiment, the gantry beam is secured to the mast 104 and to the setback structure 112 and spans the access path 114*a* between the open drill floor deck area 110*a* and the well centres. The gantry beam 125 is operable to be hoisted and lowered at least between an operational position elevated above the drill floor deck, and a lower position immediately above the drill floor deck allowing the rigging up of auxiliary equipment to the mounting structure. For example, the lower position may be no more than 2 m above the drill floor deck or another height sufficiently low for personnel to attach equipment to the gantry beam directly from the drill floor deck. The elevated position may be at least, 3 m, 5 m, or 10 m above the drill floor deck, such as at least 15 m above the drill floor deck, e.g. at least 20 m above the drill floor deck. To this end, the gantry beam may be mounted on rails or tracks extending upwardly along the support structures to which the gantry beam is connected. The gantry beam may then be lifted by wires or cables, by a hydraulic mechanism, or by another suitable hoisting mechanism. For example, the gantry beam 125 and the guard structure 119 may be mounted to the same hoisting mechanism. In some embodiments, the gantry beam may even be a part of the guard structure. It will be appreciated that a gantry beam or similar mounting structure may be arranged proximal to, and operable with, each of the well centres or proximal to, and operable with, only one of the well centres as in the example of FIGS. 1-8.

When the gantry beam 125 is lowered to its lower position, the rig crew may conveniently rig up the gantry beam with suspendable equipment that is to be lowered through one of the well centres. Examples of such equipment include logging-while-drilling equipment, measuring-while-drilling equipment, coiled tubing equipment. To this end, the equipment to be lowered through the well centre may be connected to a wire, cable or coiled tubing 135 which in turn may be led via hooks, pulleys, guide arches and/or similar guide members 129 that are connected to the gantry beam 125 to reels, drums, or similar on-deck auxiliary equipment 111 positioned on one of the open drill floor deck areas 110*a,b*. In some embodiments, the rigging up may thus be performed without any need for members of the drill crew to climb to unsafe heights. Moreover, the rigging up is performed away from the well centre, thus not interfering with any activity performed at the same time at the well centre. Once rigged up, the gantry beam 125 is hoisted to the desired height thus allowing lowering the suspendable auxiliary equipment through the well centre 123*a* at a suitable angle. The reels, drums or other on-deck auxiliary equipment 111 used for lowering the suspendable auxiliary equipment through the well centre may conveniently be positioned, e.g. skidded on skid beams 116, at a desired location within the open drill floor deck area 110*a*.

The main deck 120 is located beneath the drill floor deck and allows heavy subsea equipment 124, e.g. BOPs and Christmas trees to be moved to the moon pool 122 under the well centres so as to allow such equipment to be lowered toward the seabed. Consequently, the drill floor deck and, in particular, the part of that drill floor deck that is located in close proximity to the well centre may be stationary and does not need to be hoisted or lowered for the subsea equipment to be lowered to the seabed.

One or more iron roughnecks 127 or similar pipe handling equipment may be arranged on the drill floor deck in immediate proximity of the well centres. Such equipment may be arranged such that it may serve only one of the well centres or both well centres.

As may be most easily seen in FIGS. 4-6, risers may be moved directly from the riser storage area 115 through one of the gaps 126*a,b* to one of the well centres 123*a,b*. To this end, a riser may be moved by a gantry crane 136 from its position in the storage area 125 onto a chute 132*a,b*, respectively, or other suitable pipe feeding equipment, defining a slanted surface extending upwards and towards one of the gaps 126*a,b*. The riser may then be picked up by the top drive 137*a,b* of the corresponding hoisting system 105*a,b* and pulled into vertical position above the corresponding well centre 123*a,b*. FIG. 4 shows a riser 128 positioned on the chute 132*b* and extending through the gap 126*b* towards the well centre 123*b*. FIG. 5 shows the riser connected to the top drive 137*b* of the hoisting system 105*b* and in the process of being hoisted upwards and through the gap 126*b* towards the well centre 123*b*. FIG. 6 shows the riser after being hoisted into a vertical position above the well centre 123*b* and ready to be lowered through the well centre 123*b*.

Figure 8:
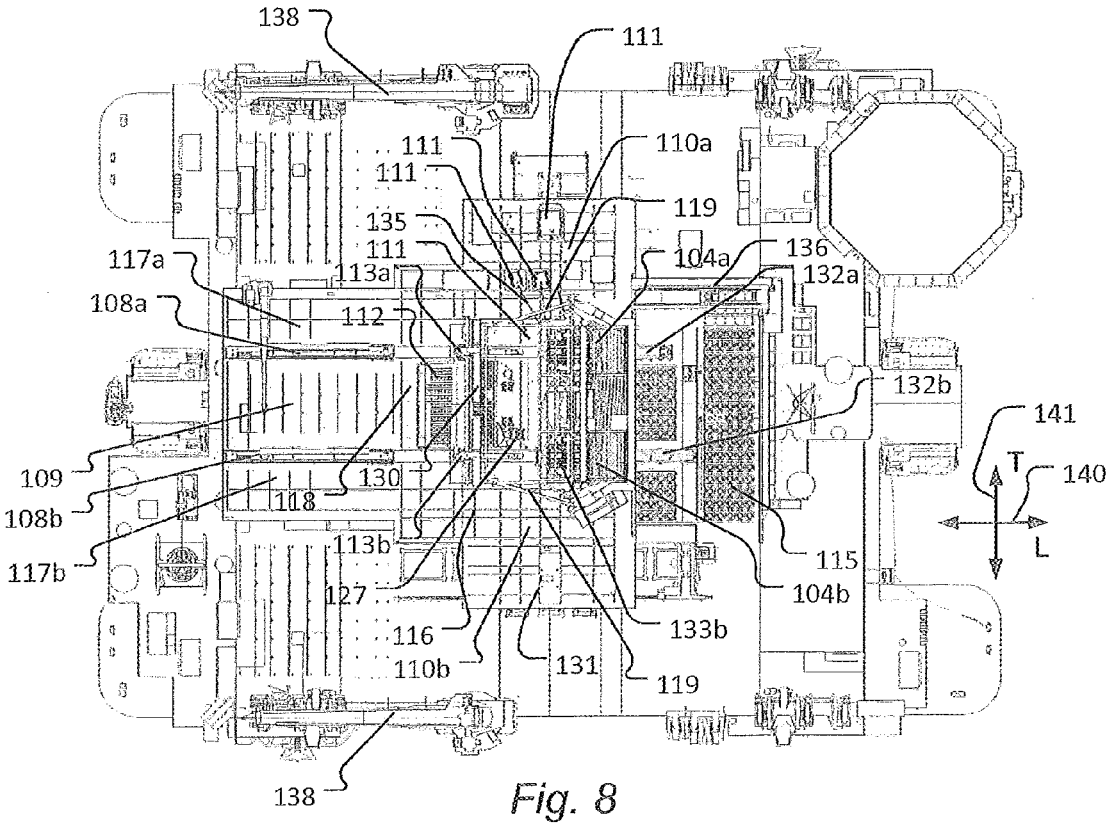

As is most easily seen in FIG. 8, the drilling rig comprises access to the well centre from all four sides, i.e. from both longitudinal directions and from both transverse directions. Moreover, the symmetrical arrangement of the mast, the well centres and the pipe storage and handling equipment allow tubulars from all storage areas to be efficiently moved to both well centres. In some embodiments, both mast portions and hoisting systems may be designed in a similar or even identical fashion and provide similar or even equal hoisting capacity. Consequently, full redundancy of the dual drilling system may be achieved. It will be understood, however, that the dual system may alternatively be designed with a primary and a secondary well centre/hoisting system e.g. with different hoisting capacities. In such embodiments, a certain degree of redundancy may still be achieved.

Even though the embodiment of FIGS. 1-8 has been described in the context of a semi-submersible, it will be appreciated that the described features may also be implemented in the context of a drillship or other type of drilling rig. In particular, the guard structure, the mounting structure, the open drill floor areas, unobstructed access paths to the well centres, and/or the gap between the hoisting cylinders may be implemented on another type of drilling rig.

Figure 9:
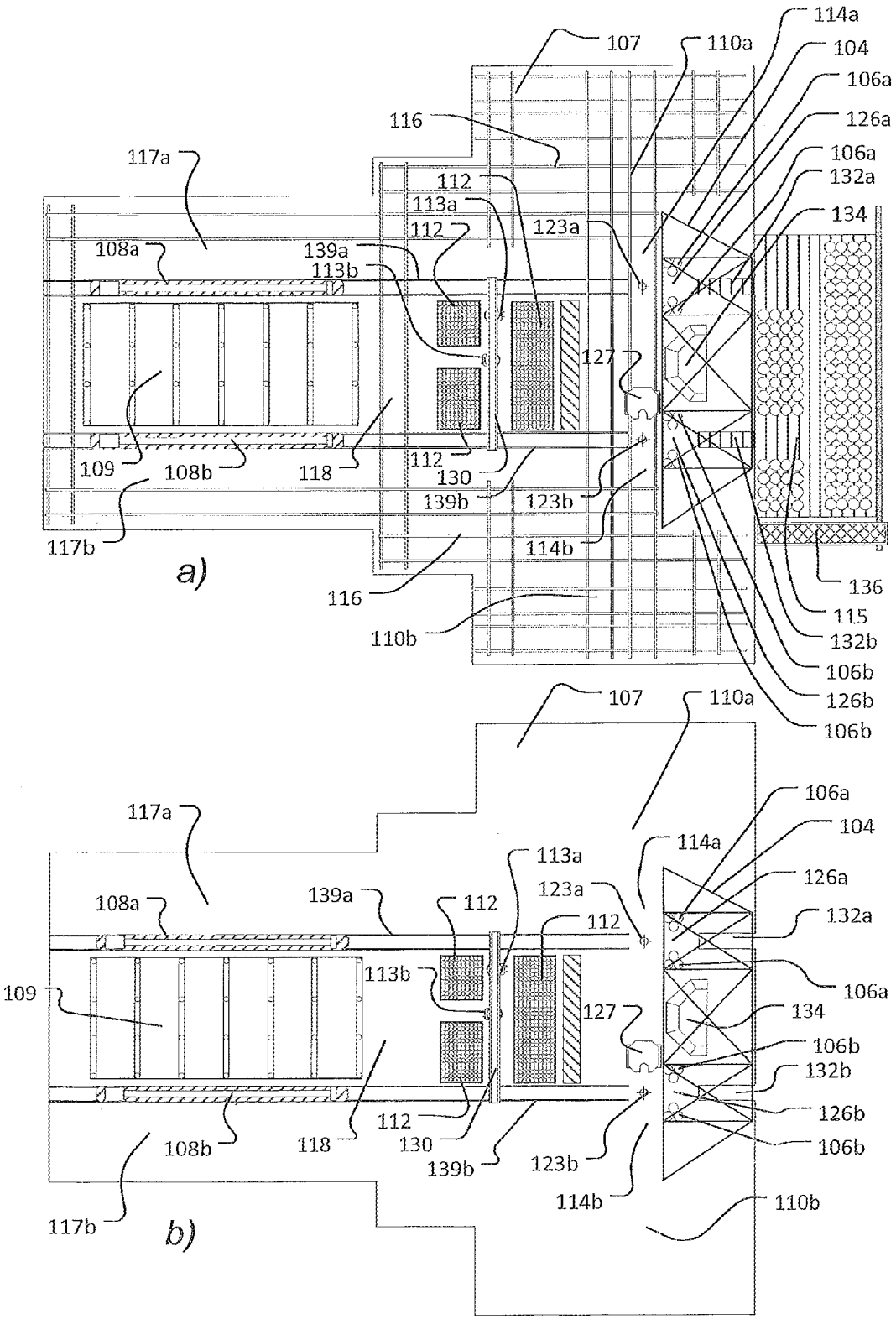
FIG. 9 schematically illustrates further embodiments of the deck layout of the drill floor deck of a drilling rig.

FIG. 9 shows top views of another example of a drill floor deck 107. FIG. 9*a* shows the drill floor deck and adjacent storage area 115 for risers, while FIG. 9*b* only shows the drill floor deck. Furthermore, while FIG. 9*a* shows the skid beams 116 arranged throughout the drill floor deck, the skid beams are not shown in FIG. 9*b* for the purpose of a simpler illustration. This embodiment of a drill floor deck is similar to the drill floor deck that was described with reference to FIGS. 1-8 above. In particular, the embodiment of FIG. 9 comprises a large drill floor deck 107, a dual activity mast 104 and corresponding well centres 123*a,b* arranged side by side, a horizontal pipe storage area 109, a setback structure 112 with vertical pipe handling equipment 113*a,b*, all as described above.

As can easily been seen in FIGS. 9*a-b*, the vertical pipe handling equipment 113*a,b* is movable along the transverse direction along a support beam 130. They may be positioned in longitudinal extension of respective ones of the catwalk machines 108*a,b* between the catwalk machine and the corresponding well centre 123*a,b*, i.e. on the pipe feeding path defined by the corresponding catwalk machine between the catwalk machine and the corresponding well centre. The catwalk machines 108*a,b* are movable on respective rails or skid beams 139*a,b* along the horizontal direction to a respective well centre. Hence, the skid beams define longitudinal pipe feeding paths to the respective well centres.

Also, an iron roughneck 127 is shown positioned between the well centres 123*a,b* and arranged on skid beams, thus allowing the iron roughneck to be moved out of the way, and alternatingly serve both well centres.

Also FIG. 9*a* clearly shows the cylinders 106*a,b* forming a gap 126*a,b*, respectively, so as to allow access to the well centres 123*a,b* directly from the riser storage area 115 by means of a gantry crane 136 and respective chutes 132*a,b* leading to the respective well centre.

FIGS. 9*a,b* also show the driller's cabin 134 positioned inside the footprint of the mast 104, transversely between the well centres. Hence, the driller's cabin does not interfere with the access paths 114*a,b* from the open drill floor deck areas 110*a,b*, while allowing convenient visual control with both well centres. The open drill floor deck areas 110*a,b* comprise parts 117*a,b* that extend along the catwalk machines, and a connecting drill floor deck area 118 connecting the lateral open drill floor deck areas 110*a,b* with each other, also all as described above.

Figure 10:
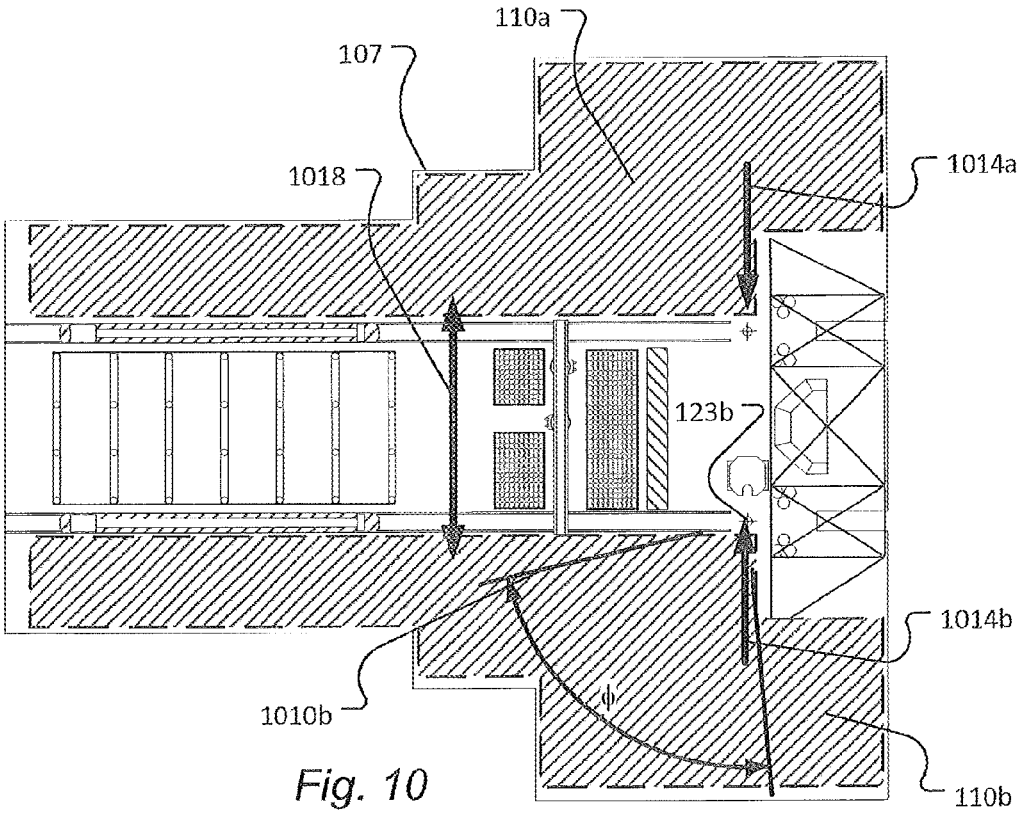
FIG. 10 schematically illustrates the open drill floor deck areas in an embodiment of a drilling rig.

FIG. 10 shows the drill floor deck 107 of FIGS. 9*a,b* clearly illustrating the open drill floor deck areas 110*a,b* as hatched areas. The drill floor deck area extending outside the footprint of the first mast is sized and shaped so as to allow installation of skid beams for skidding equipment and/or for a forklift or other vehicles to operate on the drill floor deck area outside the mast footprint. For example, the drill floor deck area outside the mast footprint may be at least 200 $m^2$, such as at least 500 $m^2$, such as at least 1000 $m^2$, such as at least 2000 $m^2$, e.g. at least 5000 $m^2$. The open drill floor deck areas are not otherwise obstructed by fixed installations such as the first mast, further masts, pipe handling equipment, and/or the like. The open drill floor deck area has a free height of at least 10 m, such as at least 20 m, e.g. at least 30 m. FIG. 10 also illustrates the lateral access from the open drill floor deck areas to the well centres by arrows 1014*a,b*. The access paths 1014*a,b* are straight and they extend entirely outside the footprint of the mast. The additional path connecting the open drill floor deck areas with each other is illustrated by arrow 1018. All access and connecting paths 1014*a,b* and 1018 are wide enough to be equipped with skid beams and/or allowing fork lifts or similar vehicles to operate across the entire drill floor deck. For example, the access and connecting paths may each be at least 2 m wide, such as at least 3 m e.g. at least 5 m wide. FIG. 10 further illustrates the large open drill floor deck sector 1010*b* around the well centre 123*b*. The sector 1010*b* may have a radius of at least 5 m such as 20 m, such as 30 m, the sector having a central angle $\phi$ of at least 60°, such as at least 90°, e.g. at least 120°.

Generally, as illustrated by sector 1010*b*, each well centre defines polar coordinates $(\theta,\rho)$ on the drill floor deck where the mast position resides at $\theta=0$ and the mast footprint spans from $\theta_{mast,min}$ (negative) to $\theta_{mast,max}$ intersecting at $\rho_{mast,min}$ and $\rho_{mast,max}$ at these angles, respectively. In some embodiments, the open drill floor deck spans more than 1 m, such as more than 2 m, such as more than 5 m, such as more than 10 m, e.g. more than 20 m within an angle interval $\Delta\theta$ spanning from $\theta_{mast,max}$ or below $\theta_{mast,min}$. In some embodiments, $\Delta\theta$ is larger than 10°, such as larger than 30°, such as larger than 60°, such as larger than 90°, e.g. larger than 30°.

Figure 11:
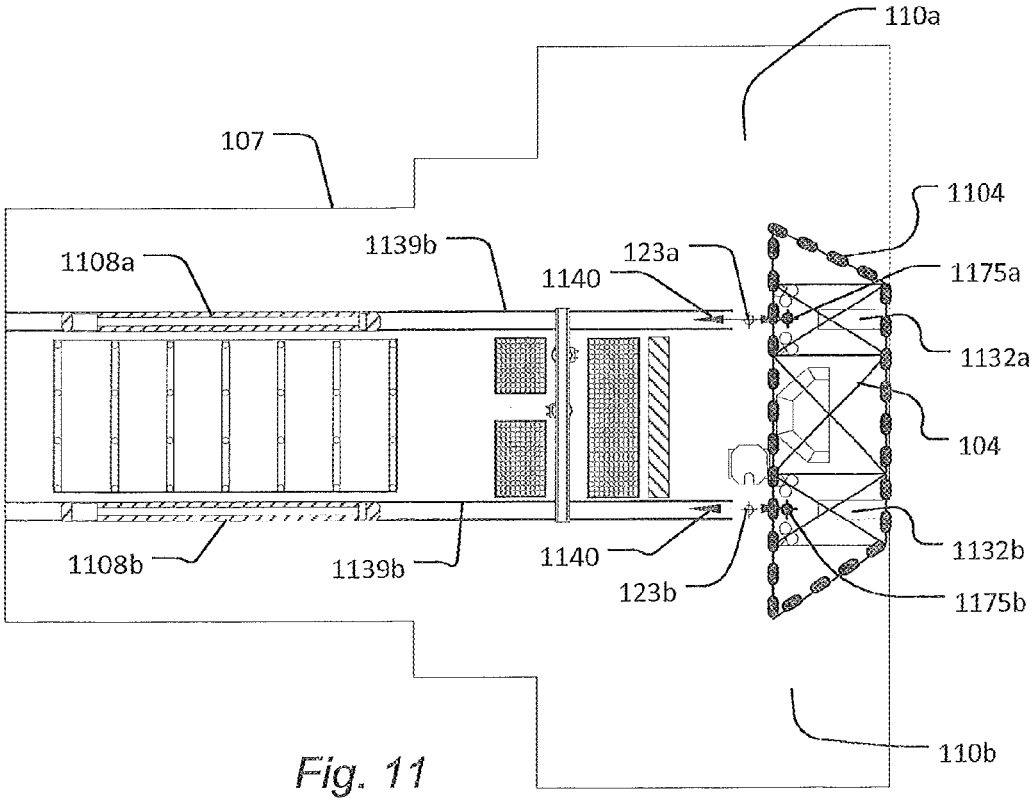
FIG. 11 schematically illustrates the footprint of the mast in an embodiment of a drilling rig.

FIG. 11 shows the drill floor deck 107 of FIGS. 9*a,b* clearly illustrating the footprint of the mast 104 by a dotted line 1104. The well centres 123*a,b* are each located outside the footprint, and they are displaced from the footprint and from the cylinders 106*a,b* along the longitudinal direction 1140. The longitudinal direction 1140 may be defined by the position of the well centres 123*a,b* and the positions 1175*a,b* of the corresponding hoisting systems. The position of the hoisting system may be defined by the centre of mass of the corresponding one of the sheaves 133*a,b* shown e.g. in FIG. 1. FIG. 11 also illustrates the pipe feeding paths along which tubulars are advanced to the respective well centres, namely the pipe feeding paths 1239*a,b* defined by the skid beams of the catwalk machines 1108*a,b*, and the pipe feeding paths 1132*a,b* defined by respective chutes for advancing tubulars from a rear side of the hoisting systems. In this embodiment, all pipe feeding paths extend along the longitudinal direction 1140, and they do not cross or otherwise interfere with the open drill floor deck areas 110*a,b*.

Figure 12:
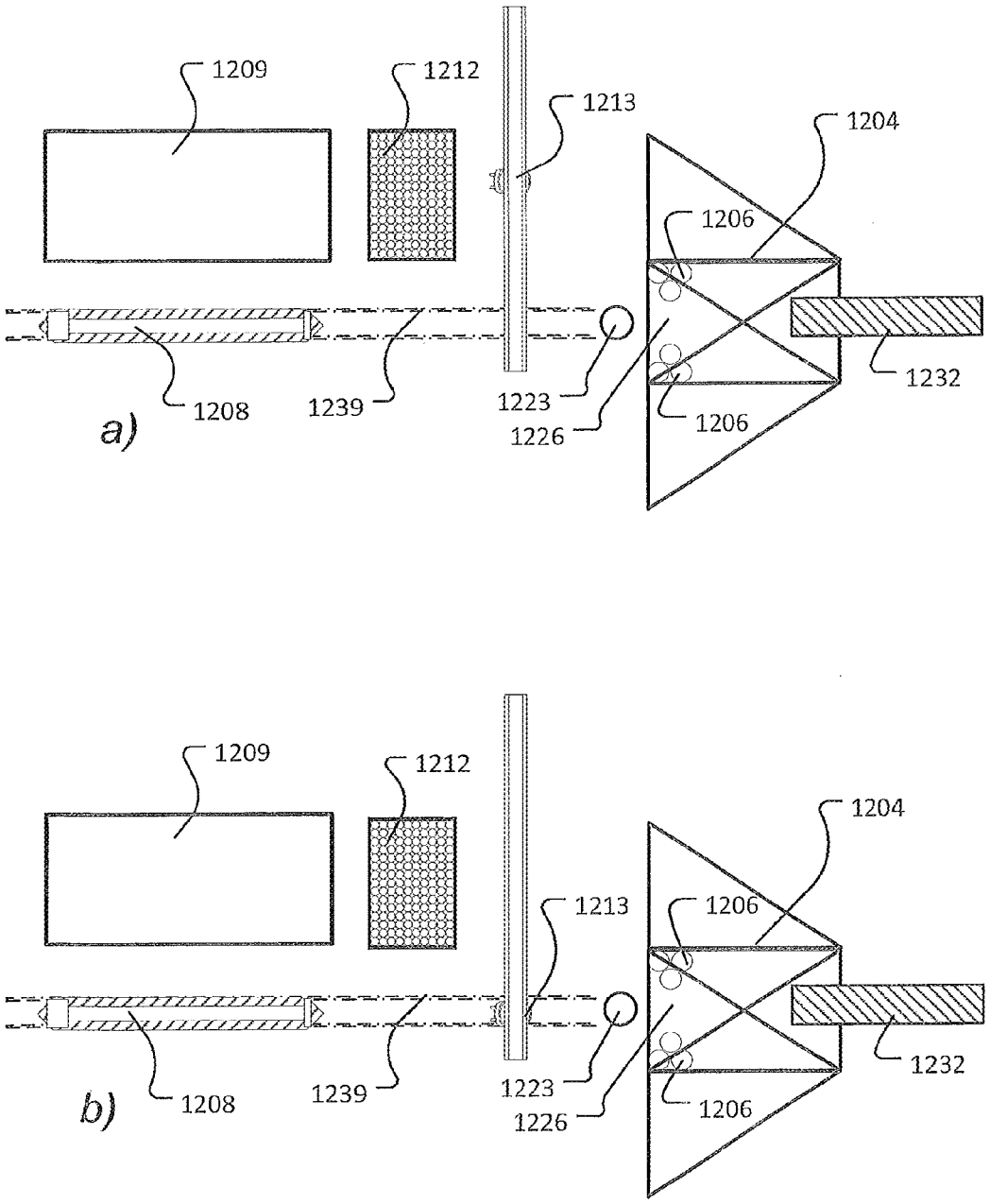
FIG. 12 schematically illustrates drill floor deck layouts of another embodiment of a drilling rig.

FIG. 12 illustrates a drill floor deck layout with a single well centre 1223, but using the same principles as described in connection with the drilling rig shown in FIGS. 1-8. The drilling deck of FIG. 12 comprises a mast 1204, a well centre 1223, a pipe storage area 1209, a setback structure 1212, horizontal pipe handling equipment 1208 and vertical pipe handling equipment 1213, all as described above. Also in this embodiment, the drilling rig comprises access paths to the well centre from all four sides, i.e. from both longitudinal directions and from both transverse directions.

In FIG. 12*a*, the vertical pipe handling equipment 1213 is positioned away from and, in particular, transversely displaced relative to the pipe feeding path defined by rails or skid beams 1239 between the horizontal pipe handling equipment 1208 and the well centre 1223. Hence, in this position the horizontal pipe handling equipment 1208 may move along skid beams 1239 all the way to the well centre 1223.

FIG. 12*b* shows the vertical pipe handling equipment 1213 in a position on the pipe feeding path 1239 connecting the horizontal pipe handling equipment 1208 and the well centre 1223. Hence, in this configuration, the horizontal pipe handling equipment 1208 may cooperate with the vertical pipe handling equipment 1213.

As in the previous embodiments, the mast comprises a hydraulic hoisting system where the cylinders 1206 are arranged so as to form a central gap 1226, through which risers from a storage area behind the mast may be moved to the well centre 1223 e.g. using a chute 1232 or other pipe handling equipment.

Figure 13:
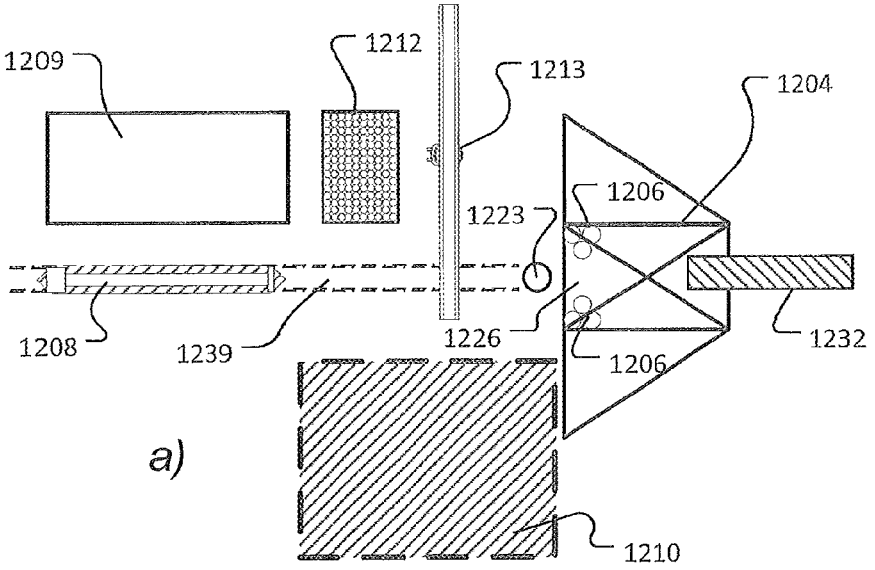
FIG. 13 schematically illustrates drill floor deck layouts of further embodiments of a drilling rig.
Figure 13:
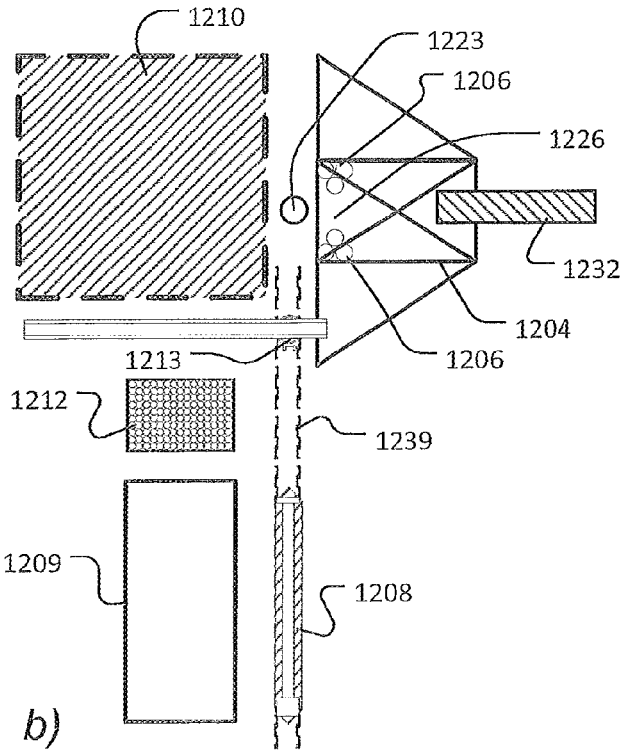

FIG. 13 shows embodiments of a drill floor deck similar to the one of FIG. 12, comprising a mast 1204, a well centre 1223, a pipe storage area 1209, a setback structure 1212, horizontal pipe handling equipment 1208 movable on rails 1239, vertical pipe handling equipment 1213, a hoisting system comprising cylinders 1206 arranged in groups forming a gap between them, and pipe handling equipment 1232 for moving risers or other tubulars through the gap 1226, all as described above.

In particular, in the example of FIG. 13*a*, the pipe storage area 1209, the setback structure 1212, the horizontal pipe handling equipment 1208 and the vertical pipe handling equipment 1213 are located longitudinally aligned with the mast 1204. In the example of FIG. 13*b*, the pipe storage area 1209, the setback structure 1212, the horizontal pipe handling equipment 1208 and the vertical pipe handling equipment 1213 are located transversely displaced from the mast. Hence, in FIG. 13*a* the pipe feeding path 1239 used by pipe handling equipment 1208 extends in the longitudinal direction as in the previous examples, while in the example of FIG. 13*b*, the pipe feeding path 1239 extends in a transverse direction. Nevertheless, in both examples, the drill floor deck comprises an open drill floor deck area 1210 shown schematically as a hatched area. In FIG. 13*a*, the open drill floor deck area is located adjacent the mast in the transverse direction, while the open drill floor deck area of FIG. 13*b* is located adjacent the first mast in the longitudinal direction.

Figure 14:
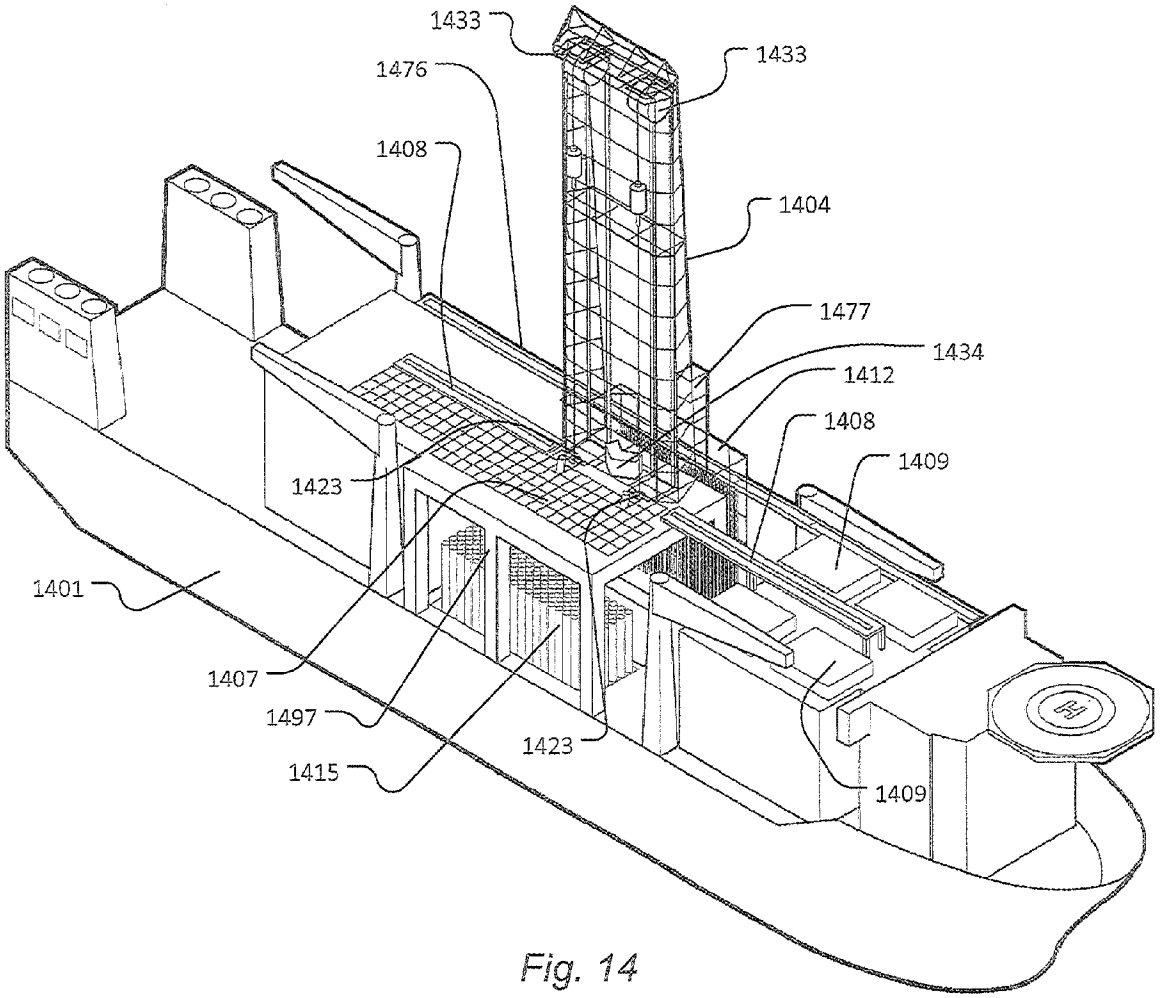
FIG. 14 illustrates another embodiment of an offshore drilling rig.

FIG. 14 illustrates another embodiment of an offshore drilling rig. The drilling rig of FIG. 14 is a drillship having a hull 1401. The drilling rig comprises a drill floor deck 1407 formed on top of a substructure 1497. The substructure comprises a platform supported by legs. The platform defines the drill floor deck and spans across a moon pool formed in the hull of the drillship. The drill floor deck 1407 comprises two holes defining well centres 1423 located next to a dual activity mast 1404. The direction intersecting with both well centres defines a transverse direction which, in this case, is parallel with a longitudinal axis of the drillship. The dual activity mast 1404 is supported by the substructure 1497 and extends upwardly from the drill floor deck 1407. The mast comprises two mast portions arranged side by side in the transverse direction such that they are both located on the same side relative to the well centres. Each mast portion accommodates a hoisting system, each for lowering a drill string through a respective one of the well centres 1423 towards the seabed. In the example of FIG. 14, the hoisting system is a draw-works system where the hoisting line is fed over stationary sheaves 1433 carried by support members. The drawworks motor/drum (not shown) may be positioned at a suitable location on the drilling rig. Alternatively, other hoisting systems such as a hydraulic hoisting system may be used, as will be illustrated below. Each well centre is located next to one of the mast portions and the corresponding hoisting system. The position of each of the well centres relative to the corresponding hoisting system defines a longitudinal direction, in this example the transverse direction of the drill ship.

The side-by-side configuration of the dual activity mast and well centres allows for efficient dual operations, easy access to both well centres, and convenient visual control of both well centres from a single driller's cabin 1434 which may e.g. be positioned symmetrically relatively to the well centres but displaced from the axis connecting the well centres, e.g. within the footprint of the mast. The driller's cabin may be split up into two or more cabins.

The drilling rig comprises a setback structure 1412 or similar pipe storage structure for storing stands of tubulars such that the stored tubulars are located partly or completely below the level defined by the drill floor deck, i.e. below the uppermost platform of the substructure 1497 and partly covered by the drill floor deck 1407. The setback structure comprises a support framework supporting fingerboards having horizontally extending fingers between which tubulars may be stored. The setback structure is positioned and arranged so as to allow stands to be moved to/from both well centres from/to the setback. To this end, on or more column rackers or similar vertical pipe handling equipment may be arranged to move stands into and out of the setback structure 1412. The handling of tubulars to and from the setback area 1412 will be illustrated in more detail in connection with the embodiments described below. In some embodiments, e.g. in case of stands of drill pipe or casings, the tubulars may be taller than the drill floor. Hence, when they are stored in the setback structure in an upright orientation their uppermost ends may extend above the drill floor level. When feeding them to one of the well centres they may be laid into a chute as will be described below. Alternatively, the setback structure may extend from the drill floor deck upwards. The handling of tubulars within the setback area may be performed by vertical pipe rackers or the like. The setback structure 1412 further comprises stand building equipment 1477 configured to build stands from individual pieces of pipe. An example of such stand building equipment is described in WO 02/057593. Alternatively or additionally, stands may be built on the drill floor.

In some embodiments, each mast portion and hoisting system form a respective gap between the two support members that carry the sheaves 1433, through which gap tubular equipment is movable between the setback structure 1412 towards the respective well centres.

Optionally, the drilling rig further comprises a pipe storage area 1409 for storing pipes in horizontal orientation located towards the bow of the drillship, i.e. transversely displaced from the well centres. One or more catwalk machines 1408 or similar horizontal pipe handling equipment are arranged to feed tubulars from the storage area 1409 or from other storage areas to the well centres. To this end, the catwalk machines are aligned with the axis defined by the two well centres. These catwalk machines 1408 and one or more stores for (e.g. 1409) or aft (not shown) may be used in combination or as an alternative to having riser 1415 stored below the drill deck. In the embodiment of FIG. 14 the catwalk machines 1408 may be used to provide additional riser joints, load the riser storage below the drill deck and/or to provide the drill floor with other tubulars. One or each of the catwalk machines may be operable to service both well centres. Moreover the drilling rig comprises one or more further catwalk machines travelling on tracks 1476 and configured to feed tubulars from the pipe storage area 1409 or from other storage areas on the opposite side of the mast (towards the aft of the ship) to the stand building equipment 1477. The catwalk machine(s) travelling on tracks 1476 is/are configured to travel along a direction parallel with the catwalk machines 1408, but on the other side of the mast. In the present embodiment, one or more catwalk machines may be operable to travel along a substantial portion of the length of the drillship. It will be appreciated that, in some embodiments, each catwalk machine may be configured to only travel to/from the stand building equipment 1477 without being configured to pass the stand building equipment. Consequently, the drilling rig may comprise two catwalk machines travelling on tracks 1476 on respective sides of the stand building equipment so as to be able to feed tubulars to the stand building equipment from both sides. The stand building equipment 1477 may thus receive pipes from the catwalk machine on tracks 1476, bring them in upright orientation, and connect them to other pipes as to form stands. The stands may then be placed in the setback structure for future use.

The drilling rig comprises another storage area 1415 below the drill floor deck 1407 and configured for storing risers in a vertical orientation. The risers may then be moved, e.g. by means of a gantry crane and respective chutes or other suitable pipe feeding equipment through holes in the drill floor, as will be described in more detail in connection with the description of the further embodiments below.

As the mast structure 1404 is located on one side of the well centres, and since the setback area is located on the side of the mast opposite the well centres and/or behind the driller's cabin 1434, the drill floor deck provides a large, unobstructed deck area on the side of the well centres opposite the mast. This area provides unobstructed access to both well centres and is free of pipe handling equipment. Consequently, these areas may be used as working area, e.g. for rigging up suspendable auxiliary equipment, and/or for positioning on-deck auxiliary equipment as described in connection with the example of FIGS. 1-8 above. Generally, riser joints and/or other tubulars may be tilted between an upright and a horizontal orientation by a tilting apparatus as described in co-pending Danish patent application no. PA 2013 00302, the entire contents are hereby included herein by reference.

Figure 15:
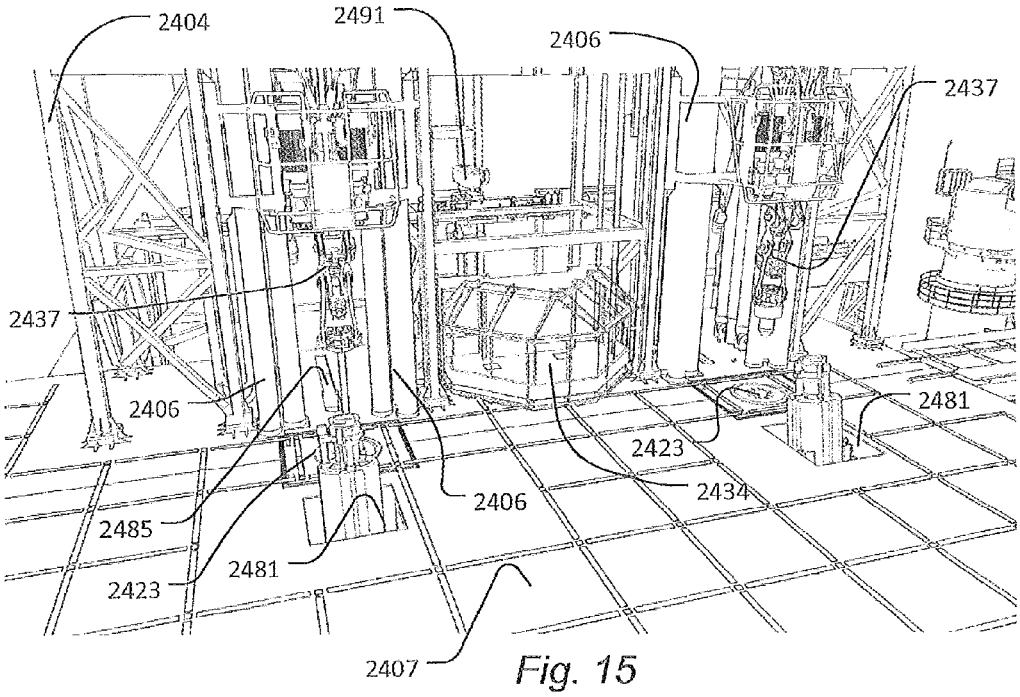
Figure 16:
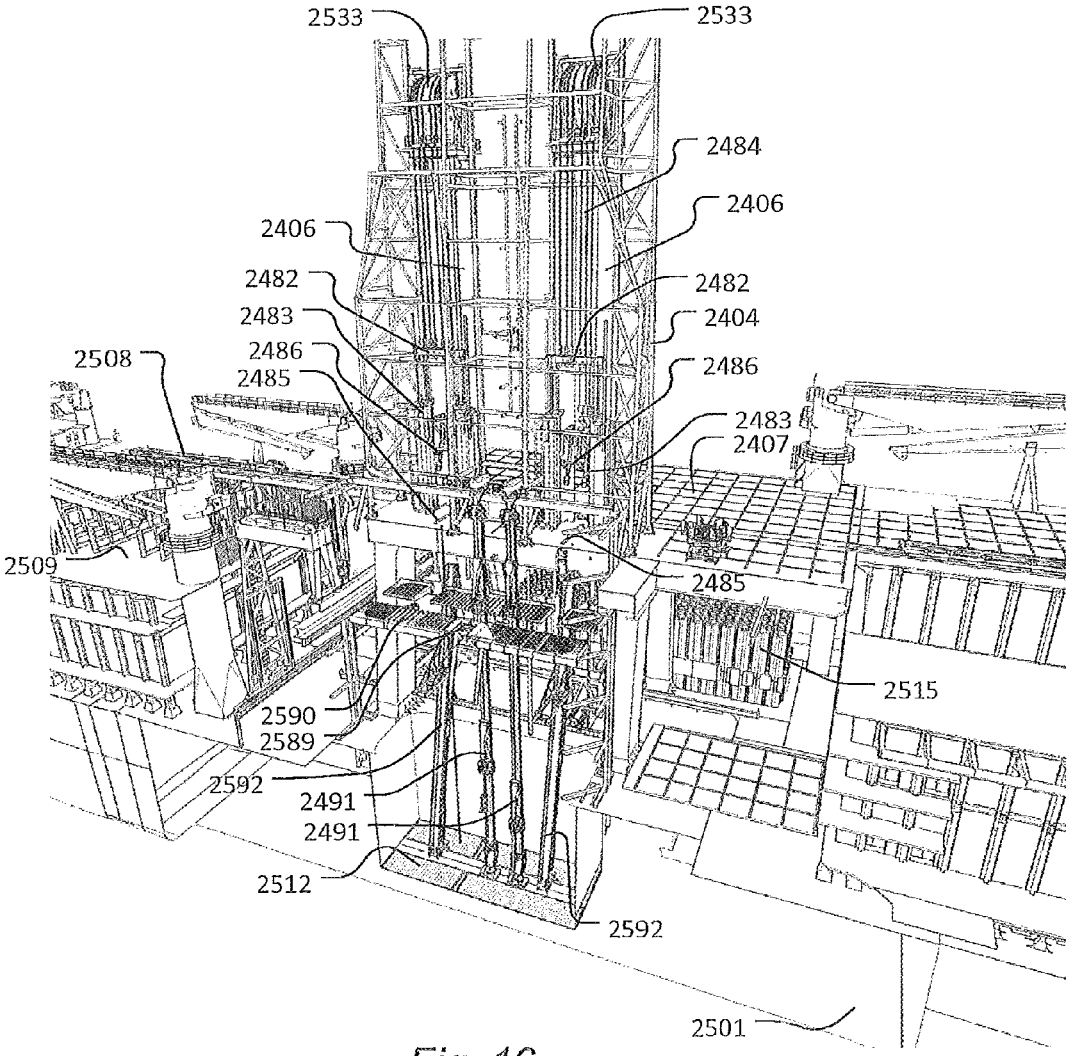
Figure 17:
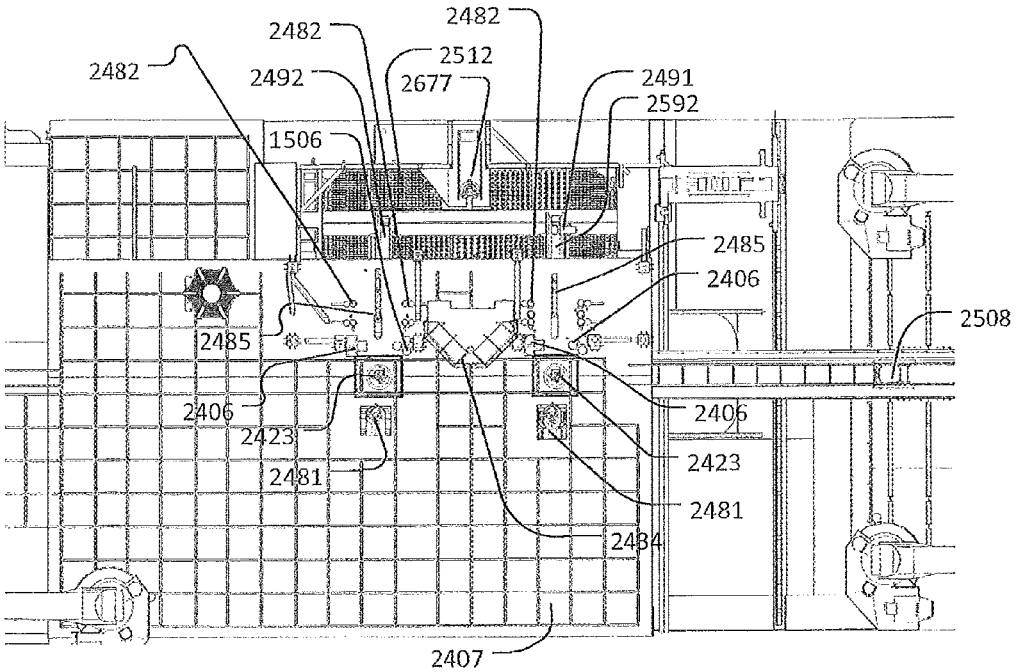
Figure 18:
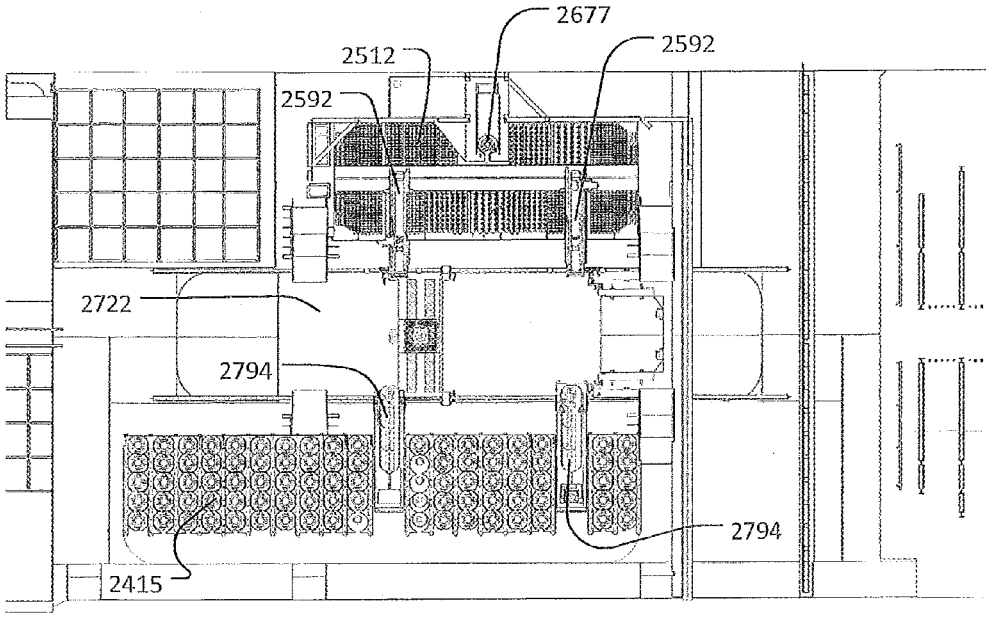
Figure 19:
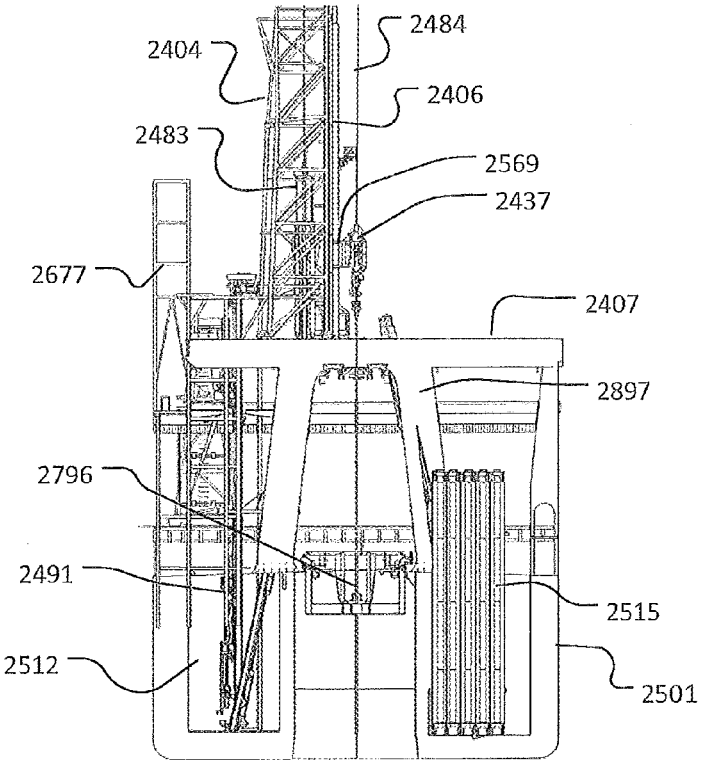
Figure 20:
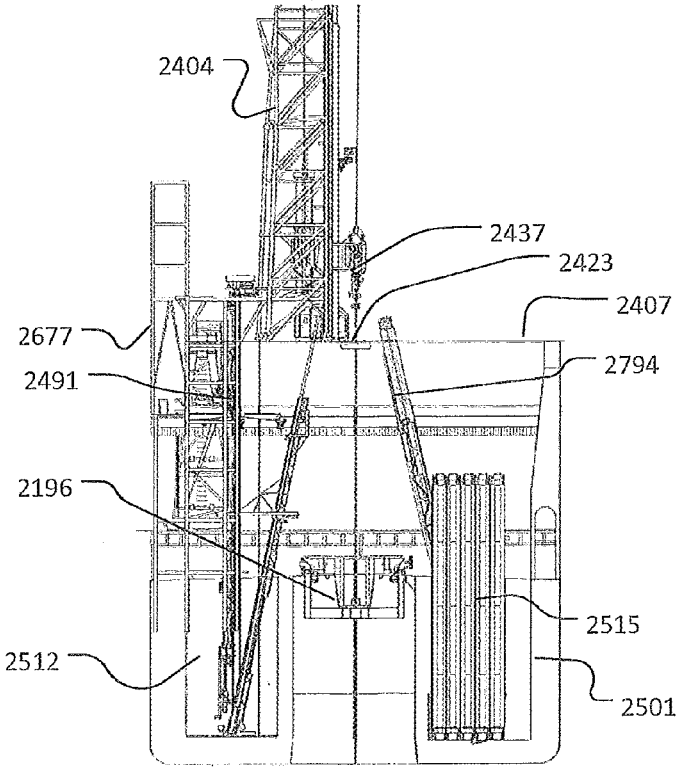
Figure 21:
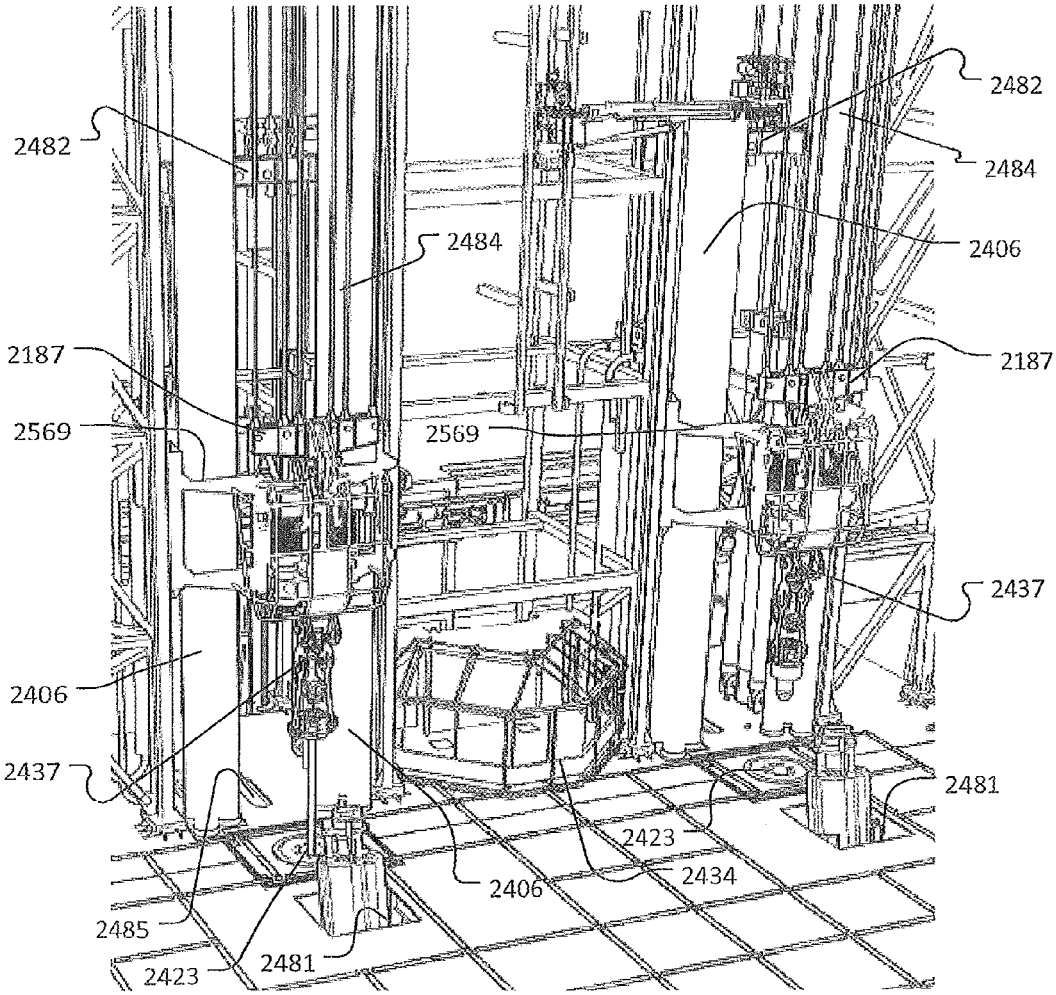

FIGS. 15-21 show another embodiment of a drilling rig, in this example of drillship having a hull 2501, similar to the drilling rig of FIG. 14 but with a different mast structure and hoisting system. In particular, FIGS. 15 and 16 show 3D views of the drill floor seen from the starboard and port sides of the drillship, respectively (a part of the hull of the ship is cut away in FIG. 16); FIGS. 17 and 18 show horizontal cross sections in a plane above the drill floor and a plane below the drill floor, respectively; FIGS. 19 and 20 show lateral cross sections of the drill ship. Finally, FIG. 21 shows another 3D view of the drill floor seen from the starboard side of the drillship.

As in the example of FIG. 14, the drilling rig of the present embodiment comprises a drill floor deck 2407 formed on top of a substructure 2897. The substructure comprises a platform supported by legs. The platform defines the drill floor deck and spans across a moon pool 2722 formed in the hull of the drillship. The drill floor deck 2407 comprises two holes defining well centres 2423, one or both being equipped with a diverter housing. The mast includes two mast portions, each associated with, and adjacent to, one of the well centres. In the present example, the well centres are located outside the footprint of the mast 2404 as described in detail in connection with FIGS. 1-8 and 14. As in the previous embodiments, the direction between each well centre and the associated hoisting system defines a longitudinal direction. In this example, the direction intersecting with both well centres defines a transverse direction which, in this case, is parallel with a longitudinal axis of the drillship. The dual activity mast 2404 is supported by the substructure 2897 and extends upwardly from the drill floor deck 2407.

As described in connection with the embodiment of FIGS. 1-8, each mast portion accommodates a respective hydraulic hoisting system each for lowering a drill string through a respective one of the well centres 2423 towards the seabed. Each hydraulic hoisting system comprises cylinders 2406, respectively, that extend upwardly from the drill floor deck and support the load to be lowered or hoisted. Each well centre is located next to one of the mast portions and the corresponding hoisting system; both well centres are located on the same side relative to the mast, i.e. in a side-by-side configuration.

The cylinders 2406 of each hoisting system are arranged in two groups that are positioned displaced from each other in the transverse direction so as to form a gap between the two groups. Each gap is thus aligned with a respective one of the well centres along the longitudinal direction and is shaped and seized so as to allow tubulars to be moved through the gap towards the respective well centre and even raised into an upright position while being located at least partly in the gap between the cylinders. The exact shape, size and location of the gap may depend on the type of tubular to be fed through the gap, e.g. whether the gap is to be used for feeding drill pipes, casings and/or riser through the gap. The well centre is longitudinally displaced from the gap. The rods of the cylinders support respective sheaves 2533, e.g in the form of a sheave cluster, over which the hoisting wires 2484 are suspended. The cable sheaves 2533 define an axis that is parallel to the direction connecting the two groups of cylinders of one of the hoisting systems. One end of the hoisting wires 2484 is anchored to the drilling rig, while the other end is connected to top drive 2437 or hook of the corresponding hoisting system, via a travelling yoke 2187. The sheaves 2533 are laterally supported and guided by the respective mast portions. Each top drive 2437 is connected via a dolly 2569 to a vertical track arranged at the mast 2404. The fixed ends of the hoisting wires are anchored via a yoke 2482 and respective sets of deadline compensators 2483. The compensators 2483 are also arranged in two groups so as to form a gap over which the yoke 2482 extends. Hence, tubulars can pass through the gap between the compensators 2483 and below the yoke 2482.

The side-by-side configuration of the dual activity mast and well centres allows efficient dual operations, easy access to both well centres, and convenient visual control of both well centres from a single driller's cabin 2434 which may e.g. be positioned transversely between the well centres, e.g. within the footprint of the mast.

The drilling rig further comprises a pipe storage area 2509 for storing pipes in horizontal orientation and catwalk machines 2508 or other horizontal pipe handling equipment for transporting pipes between the storage area 2509 and the well centres 2423, also as described in connection with FIG. 14.

The drilling rig comprises a setback structure 2512 or similar pipe storage structure for storing stands of tubulars below the substructure 2897 and partly covered by the drill floor deck 2407. The setback structure comprises a support framework 2590 supporting fingerboards having horizontally extending fingers between which tubulars may be stored. One or more column rackers 2491 or similar vertical pipe handling equipment may be arranged to move stands into and out of the setback structure 2512. The setback structure 2512 further comprises stand building equipment 2677 configured to build stands from individual pieces of pipe through a foxhole 2592. The setback structure 2512 is located adjacent the moon pool 2722 laterally displaced from the axis defined by the well centres.

Moreover the drilling rig comprises one or more further catwalk machines (not shown) configured to feed tubulars from the pipe storage area 2509 or from other storage areas on the opposite side of the mast (towards the aft of the ship) to the stand building equipment 2677, all as described in connection with FIG. 14. The stand building equipment 2677 may thus receive the pipes from the catwalk machine, bring them in upright orientation, and connect them to other pieces so as to form stands. To this end the stand building equipment may comprise a mousehole 2589 through which the stand may be gradually lowered while it is made up until the lowermost end of the stand is at the lowermost level of the setback area 2512, while the uppermost end of the stand is below the drill floor level. The stands may then be received by pipe rackers 2491 and placed in the setback structure 2512 for future use. To this end the pipe rackers are operable to traverse across the setback area, e.g. in the direction parallel to the direction connecting the well centres.

The drilling rig comprises a number of slanted chutes 2592 each for feeding pipes from the setback area 2512 to one of the well centres. Each chute 2592 receives pipes from one of the pipe rackers 2491 feeds the pipes in a slanted upward direction through a corresponding slit 2485 in the drill floor and through the gap formed by the cylinders 2406 of the corresponding hoisting system towards a respective one of the well centres 2423, where they are picked up at their uppermost end by the corresponding hoisting system and lifted through the slit 2485 until they are vertically suspended above the corresponding well centre. To this end, the drilling rig further comprises pipe handling equipment operable to guide the pipes while they are being lifted through the slit 2485. The slits 2485 are are elongated and point away from the axis connecting the well centres and towards the side where the setback area 2512 is positioned.

The drilling rig comprises another storage area 2515 below the drill floor deck 2507 and configured for storing risers in a vertical orientation, as described in connection with FIG. 14. The riser storage area 2515 is located adjacent the moon pool 2722, e.g. on the side of the moon pool opposite the setback structure 2512. The risers may be moved, e.g. by means of a gantry crane and respective chutes 2794 or other suitable pipe feeding equipment through holes 2481 in the drill deck floor. The riser feeding holes 2481 may be covered by plates, hatches or similar covers. In FIG. 15, the holes are shown in the open position with the uppermost end of a riser extending through the open hole. The riser feeding holes are displaced from the axis connecting the well centres.

As in the previous example, in the embodiments of FIGS. 14-21 a main deck is located beneath the drill floor deck and allows heavy subsea equipment, e.g. BOPs and Christmas trees to be moved to the moon pool under the well centres so as to allow such equipment to be lowered toward the seabed. Consequently, the drill floor deck and, in particular, the part of that drill floor deck that is located in close proximity to the well centre may be stationary and does not need to be hoisted or lowered for the subsea equipment to be lowered to the seabed.

As the stands of tubulars and the risers are stored below the drill floor deck, and since the catwalk machines 2508 extend towards opposite sides from the well centres, and since the mast structure 2404 is located on one side of the well centres, the drill floor deck provides a large, unobstructed deck area on the side of the well centres opposite the mast. This area provides unobstructed access to both well centres and is free of pipe handling equipment. Consequently, these areas may be used as working area, e.g. for rigging up suspendable auxiliary equipment, and/or for positioning on-deck auxiliary equipment as described in connection with the example of FIGS. 1-8 above. In particular, when no riser operations are performed, the holes 2481 may be covered or otherwise secured. Moreover, at least parts of the setback structure 2512 may be covered by a platform so as to provide additional storage or working area.

Even though the embodiments of FIGS. 14-21 have been described in the context of a drillship, it will be appreciated that the described features may also be implemented in the context of a semi-submersible or other type of drilling rig. In particular, storage of risers and/or other tubulars below the drill floor deck may be implemented on other types of drilling rigs as well. Likewise, the guard structure, the mounting structure, and other features described with the embodiments of FIGS. 1-13 may be implemented on another on the drillrigs shown in FIGS. 14-21 as well.

FIGS. 22A-22D show embodiments of a drilling rig in which stands of tubulars that are built in a stand building structure 2277 and stored vertically in a setback area 2212 behind a mast structure 2204 are delivered to a number of well centres 2223 situated on a drill floor deck 2207. Tubulars are delivered from the setback area by means of slanted chutes 2292 through corresponding slits 2285 allowing access from the setback area to the drill floor deck. The operation of running tubulars to the well centres may be controlled and monitored in the driller's cabin 2234.

Figure 22A:
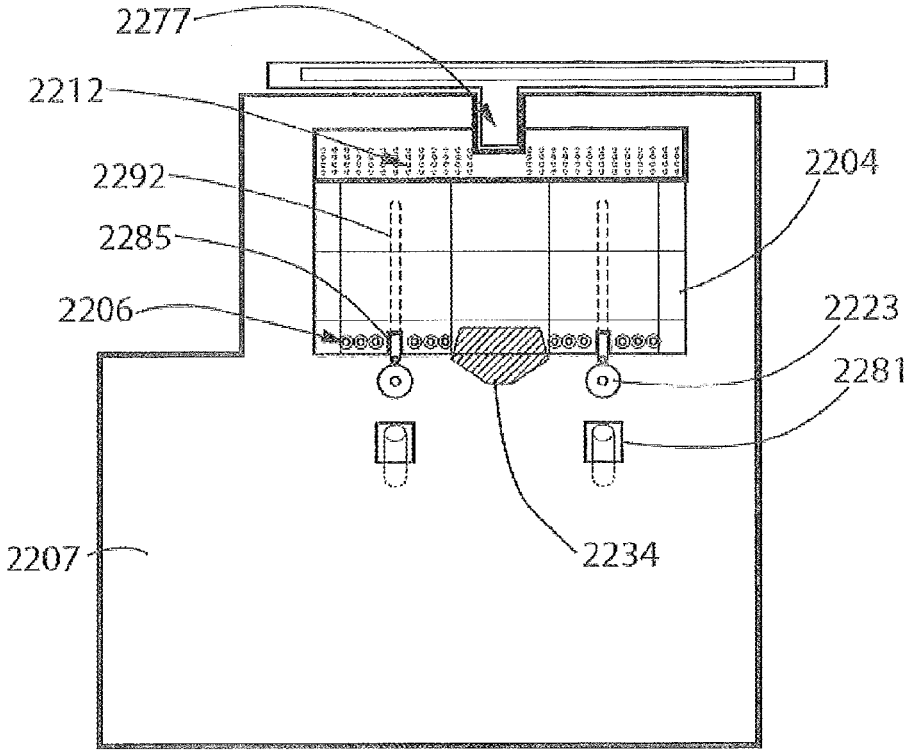
FIGS. 22A-22D show horizontal cross-sectional views of the drilling rigs illustrating different layouts in which tubulars can be fed to a well centre.

The embodiment of FIG. 22A has separate slanted chutes 2292 and slits 2285 located perpendicular to the setback area 2212 thus linking it to the drill floor deck 2207 through a gap between the cylinders of the hoisting system 2206.

Figure 22B:
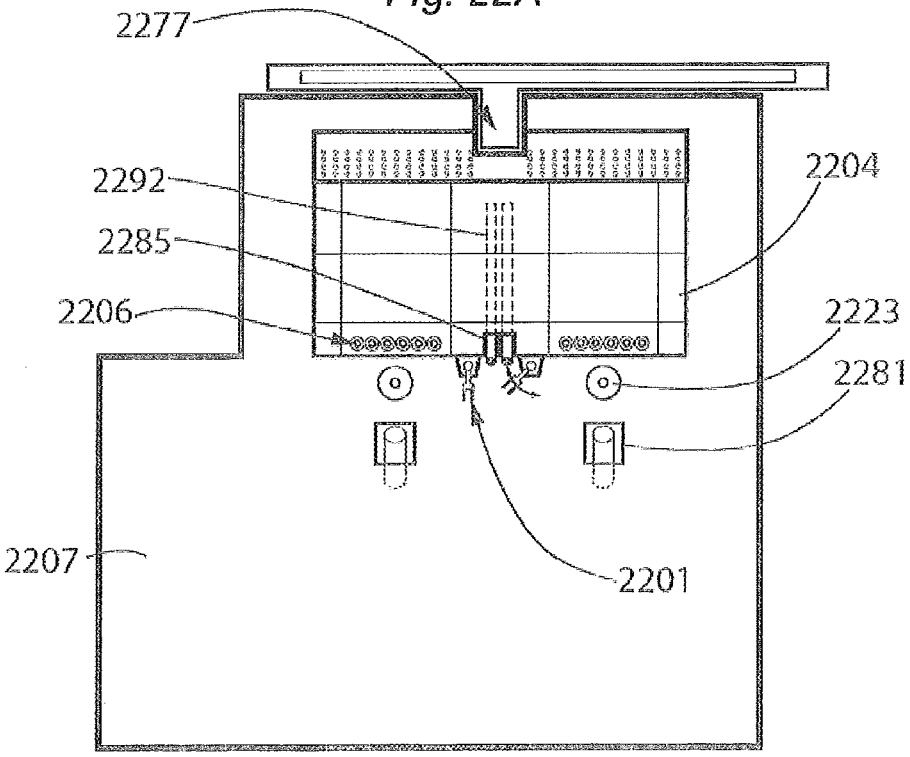

FIG. 22B shows an embodiment where the chutes and slits are located between the well centres such that tubulars are fed to the well centres by means of a number of pipe handling apparatus 2201. Two adjacent sets of chutes, slits and pipe handling apparatus are shown in order to ensure redundancy in operation in such a way that drilling operations may be performed even though one set should experience failure or otherwise be out of operation.

Figure 22C:
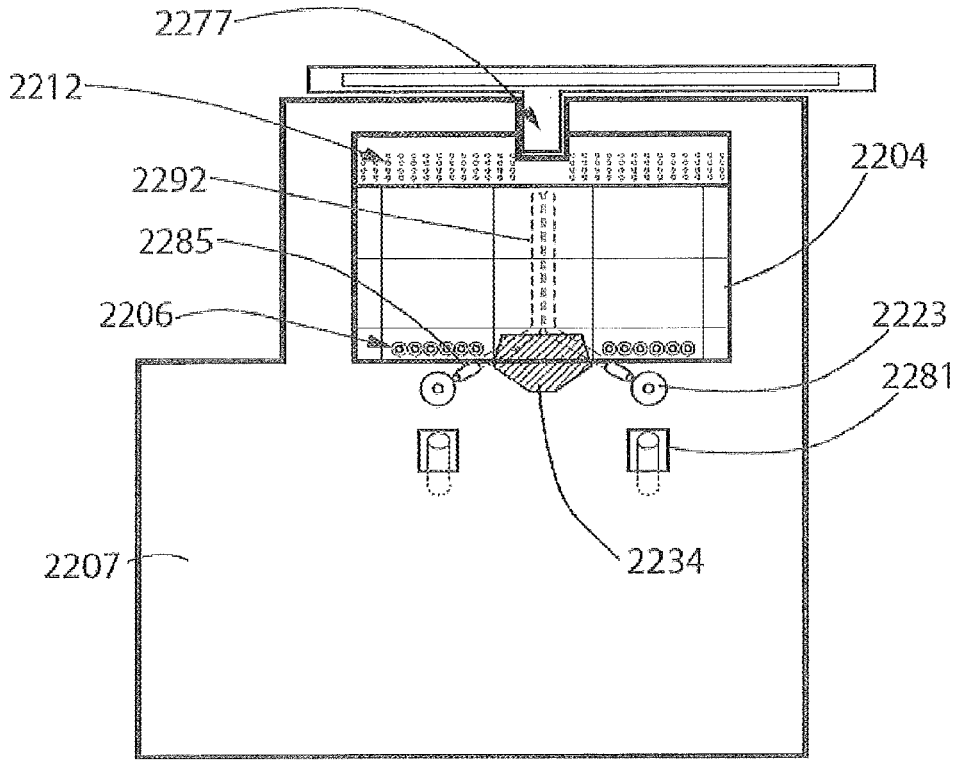

FIG. 22C illustrates an embodiment where the chutes and slits are located between the well centres and following an angled path leading to the well centres such that the chutes 2292 may feed tubulars directly to the well centres 2223. In this embodiment a gap between the cylinders 2206 of the hoisting system is not needed.

Figure 22D:
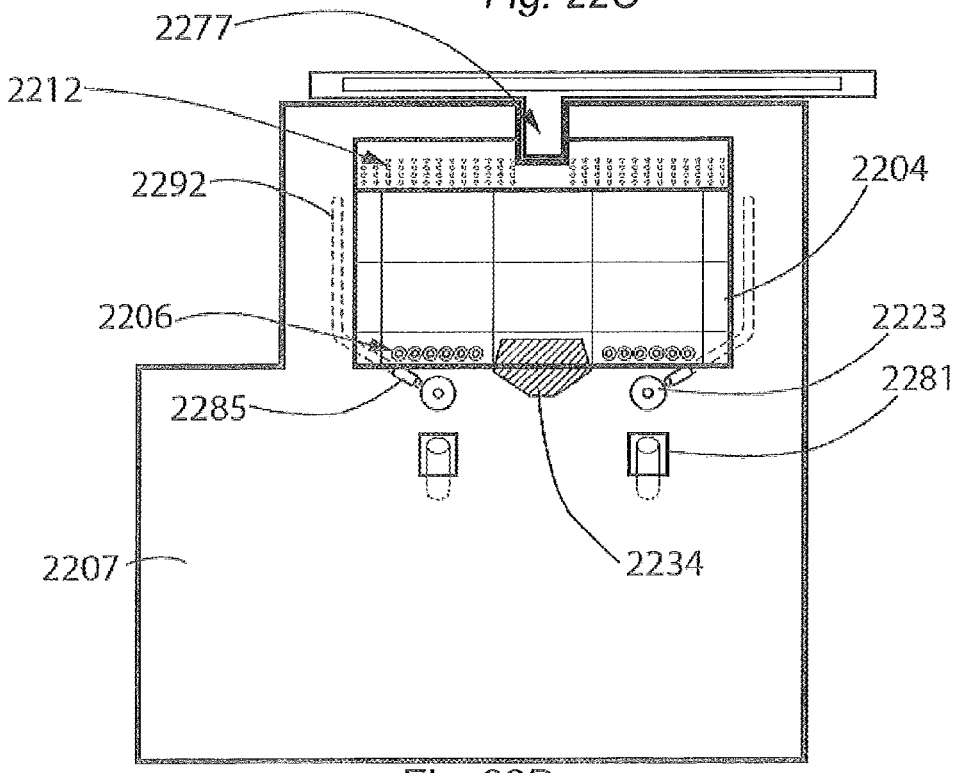

FIG. 22D illustrates an embodiment where tubulars are delivered from the setback area 2212 to the well centres 2223 following a path along the outside of the mast structure 2204.

Figure 23:
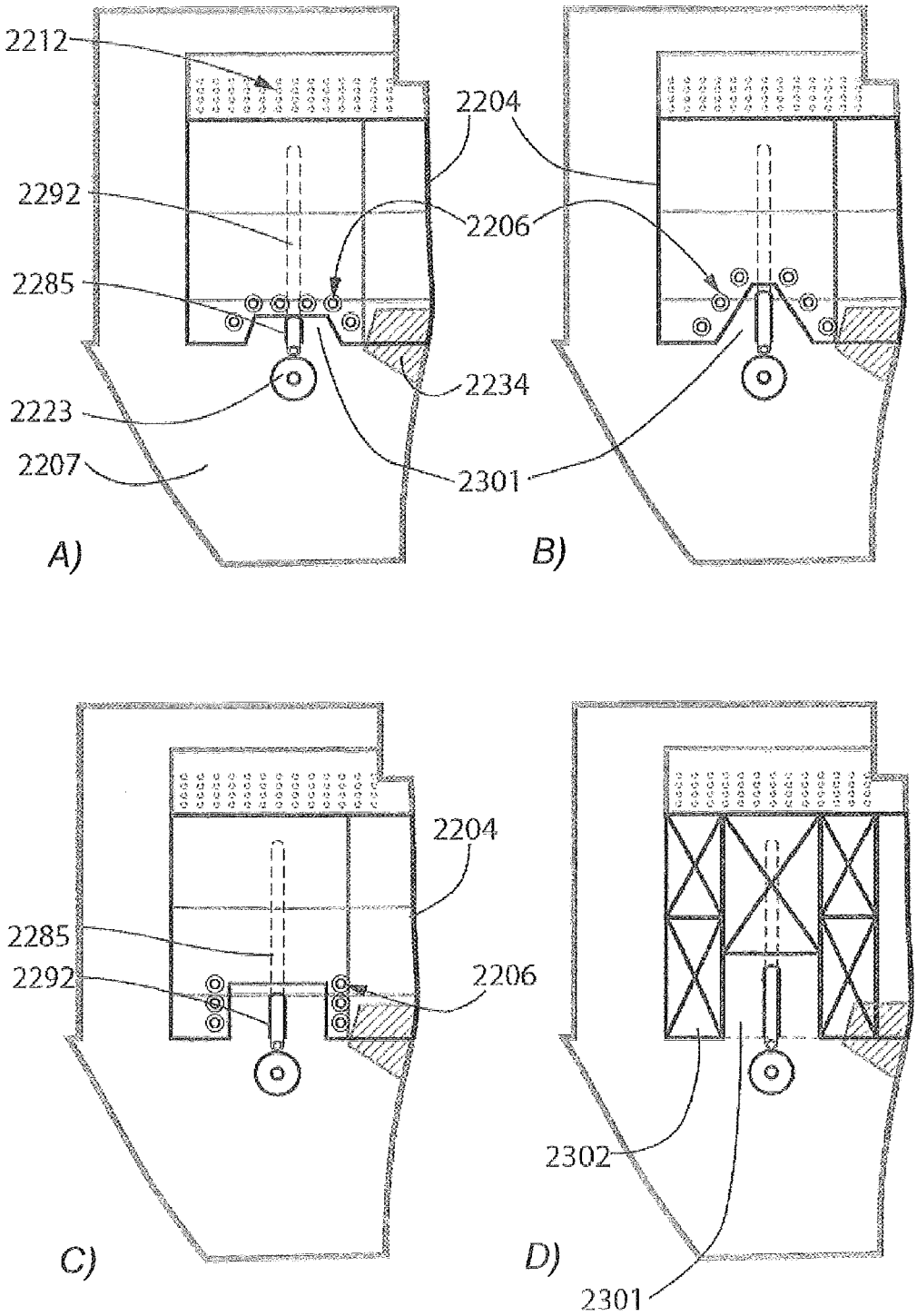
FIGS. 23 A)-D) illustrate different configurations of gaps to accommodate tubulars being delivered to a well centre.

FIGS. 23 A)-D) show cut outs of a portion of a drilling rig to illustrate various embodiments of layouts in which hoisting system cylinders 2206 are positioned inside a mast structure 2204 such that a gap 2301 into the side of the mast facing the well centre 2223 can be made. These gaps allow tubulars to be delivered from a setback area 2212 through a slit 2285 by means of a chute 2292 to a well centre 2223 without clashing with the mast structure or the hoisting system in any way.

In FIG. 23A) a layout is shown where the cylinders 2206 of the hoisting system are arranged such that a portion of them are located further inside the footprint of the mast 2204 to allow a gap 2301 in the mast such that tubulars may be fed through a slit 2285 to a well centre 2223 without interfering with the cylinders and mast structure, rendering a large spacing between the cylinders unnecessary.

FIG. 23B) shows a variation of the layout in FIG. 23A) where some of the cylinders 2206 are moved even further back inside the footprint of the mast structure 2204 to accommodate a larger gap/deeper recess compared to FIG. 23 A).

In FIG. 23C) an embodiment is shown where the cylinders 2206 are laid out in two rows facing each other to create a larger gap in the mast structure 2204 enabling access around the slit 2285 and chute 2292.

FIG. 23D) shows as embodiment where the cylinder hoisting system is replaced with a hoisting system utilising a different means of lifting, for instance a draw works, such that the load bearing qualities of the cylinders are transferred to a strengthened mast structure 2302 in such a way that this structure carries these loads entirely. The mast structure is strengthened while having enough space for a gap 2301 to allow access to the tubulars being fed to the well centres.

Figure 24:
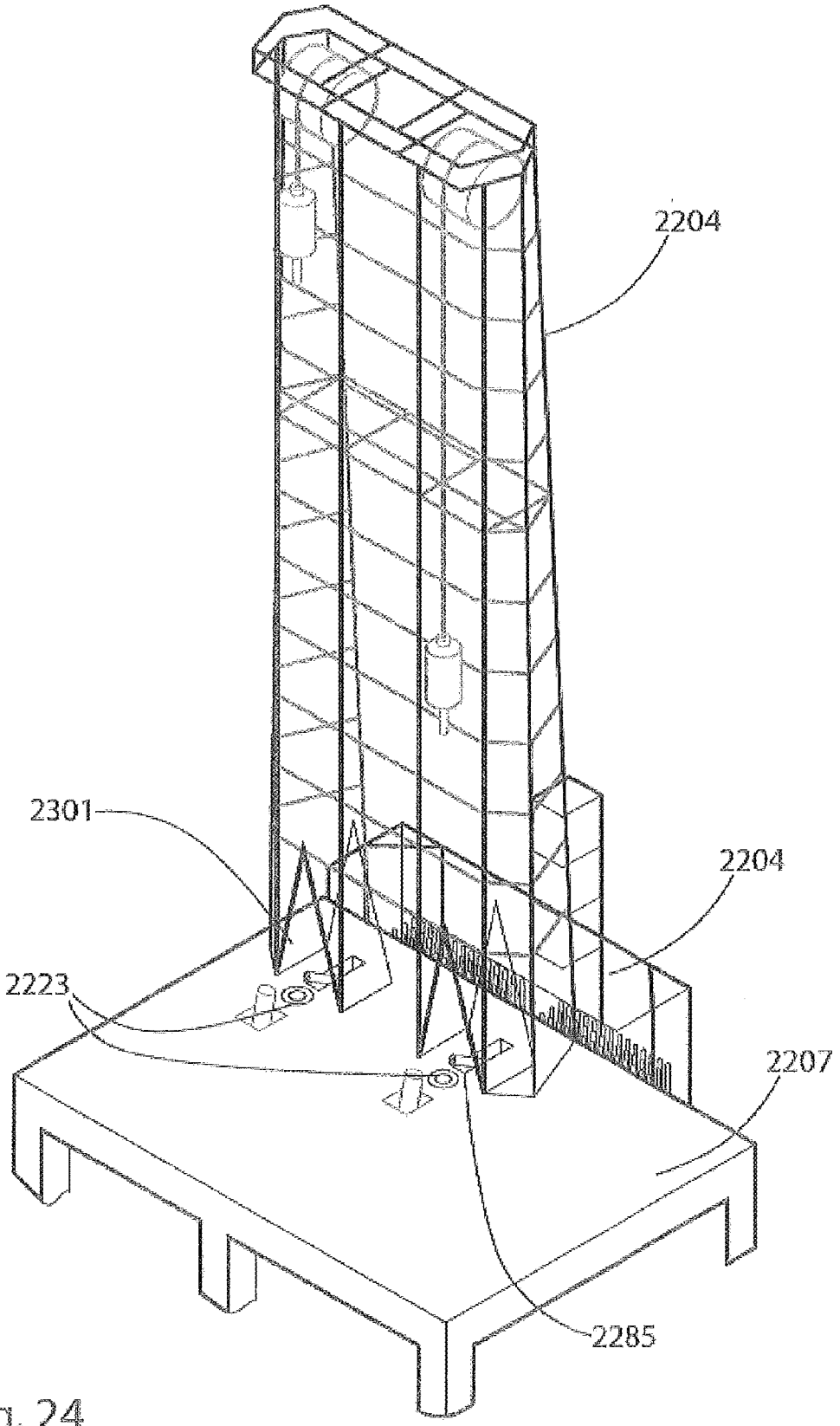
FIG. 24 shows an embodiment where a mast structure is shown having a gap to allow tubulars to be fed to a well centre.

FIG. 24 shows an embodiment of a drilling rig where a mast structure 2204 is shown having gaps 2301 to allow tubulars to be fed to well centres 2223 through slits 2285 in the drill floor deck 2207. The embodiment shown does not utilise a cylinder type hoisting system but is rather a variant of the embodiment shown in FIG. 23 D) where the mast structure is strengthened to accommodate the lack of load bearing cylinders. The lack of cylinders positioned in relative proximity to the well centres in the horizontal plane allows gaps 2301 to be provided in the mast structure for tubulars to pass under and through the mast structure to be delivered to the well centre.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

For example, the described embodiments comprise two well centres, but it will be appreciated that alternative embodiments may comprise a single well centre or a well centre and additional work centres.

The inventors have further realized that many of the advantages of several further aspects of the drilling rig described herein, e.g. the open drill floor deck, a guard structure and/or a mounting structure described herein or defined in the dependent claims may be obtained with a variety of different embodiments of drilling rigs, not limited to the specific embodiments described herein. For example, one or more of these aspects and/or other aspects may be embodied in combination with other embodiments of an offshore drilling rig, e.g. an offshore drilling rig comprising: a drill floor deck having a hole defining a first well centre; a first mast upwardly extending relative to the drill floor deck, and a first hoisting system supported by the first mast and configured for hoisting and lowering tubular equipment through the first well centre; wherein the first hoisting system is displaced from and located on a first side of the first well centre; first pipe handling equipment for moving tubular equipment to the first hoisting system so as to allow the first hoisting system to hoist or lower the tubular equipment through the first well centre.

In device claims enumerating several features, several of these features can be embodied by one and the same item of hardware. The mere fact that certain measures are recited in mutually different dependent claims or described in different embodiments does not indicate that a combination of these measures cannot be used to advantage. For example, even though not explicitly shown, it will be appreciated that the drilling rigs of FIGS. 9-13 may be provided with a guard structure as described herein and/or a hoistable mounting structure as described herein.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. An offshore drilling rig comprising:

a drill floor deck having a hole defining a first well centre;

a first hoisting system configured for hoisting and lowering tubular equipment having a weight through the first well centre via a top drive arranged to be raised over said drill floor deck up to a maximum elevation above the drill floor deck, said hoisting system comprising a load bearing structure extending upwardly from the level of the drill floor deck to a height of at least said maximum elevation and from which the top drive is suspended, said load bearing structure supporting a vertical load of said top drive and tubular equipment as it is being hoisted and lowered through the first well centre;

a first mast extending upwardly from the drill floor deck, said first mast is at least one of (i) comprising a mast portion supporting at least part of said vertical load so that said mast portion forms at least part of said load bearing structure, and (ii) supporting said load bearing structure in a horizontal direction;

wherein the load bearing structure of the first hoisting system is displaced from and located on a first side of the first well centre;

first pipe handling equipment for moving the tubular equipment to the first hoisting system so as to allow the first hoisting system to hoist or lower the tubular equipment through the first well centre;

wherein the first pipe handling equipment is operable to present said tubular equipment to the top drive in at least one of:

(i) a path from the first side towards the well center and entirely underneath the load bearing structure and under the level of the drill floor deck, and (ii) a path from the first side towards the well center where at least part of the tubular equipment passes through a gap formed in said load bearing structure.

2. An offshore drilling rig according to claim 1, further comprising a storage structure comprising a setback structure wherein said path is a path from said setback structure to a presentation to said top drive.

3. An offshore drilling rig according to claim 1, comprising a driller's cabin positioned on the first side of the first well centre.

4. An offshore drilling rig according to claim 1, wherein the drill floor deck comprises at least a first open drill floor deck area located adjacent the first mast, other than any drill floor deck area on or over which the drilling rig is configured for movement of tubular equipment or subsea equipment to the first well centre during normal drilling operation; and an access path connecting the open drill floor deck area with the first well centre.

5. An offshore drilling rig according to claim 4, wherein the drilling rig is configured to perform movement of tubular equipment or subsea equipment to the first well centre along one or more pipe feeding paths during normal use which one or more pipe feeding path only crosses drill floor deck areas outside the first open drill floor deck area.

6. An offshore drilling rig according to claim 4, wherein the access path is a straight path and extends entirely outside a footprint of the first mast.

7. An offshore drilling rig according to claim 4, wherein the first open drill floor deck area is located adjacent the first well centre in a longitudinal direction defined within a plane of the drill floor deck by the first well centre and the first hoisting system.

8. An offshore drilling rig according claim 4, wherein the first open drill floor deck area is located adjacent the first well centre in a transverse direction normal to a longitudinal direction defined within a plane of the drill floor deck by the first well centre and the first hoisting system.

9. An offshore drilling rig according to claim 1, wherein the first hoisting system comprises a draw-works operable to roll up and feed a length of hoisting line.

10. An offshore drilling rig according to claim 1, wherein the first pipe handling equipment defines a first pipe feeding path along which the tubular equipment is moved towards the first well centre, wherein the first pipe feeding path extends substantially along a longitudinal direction defined within a plane of the drill floor deck by the first well centre and the first hoisting system.

11. An offshore drilling rig according to claim 1, wherein the drilling rig further comprises:

a second work centre displaced from the first well centre;

the positions of the first well centre and the second work centre together defining a transverse direction in the plane of the drill floor deck;

a second hoisting system configured for hoisting and lowering tubular equipment through the second work centre; wherein the first and second hoisting systems are arranged side by side in the transverse direction;

pipe handling equipment for feeding tubular equipment towards the first well centre; and pipe handling equipment for feeding tubular equipment towards the second work centre; and wherein the pipe handling equipment for feeding tubular equipment towards the first well centre and the pipe handling equipment for feeding tubular equipment towards the second work centre define respective pipe feeding paths each extending substantially along the longitudinal direction normal to the transverse direction.

12. An offshore drilling rig according to claim 11, wherein the second work centre is a well centre.

13. An offshore drilling rig according to claim 1 wherein at least a part of the drill floor deck is formed by a roof of an enclosure for accommodating mud mixing equipment and/or other operational equipment of the drilling rig.

14. An offshore drilling rig according to claim 1, comprising a storage area for storing the tubular equipment located below the drill floor deck level, and pipe handling equipment for feeding such tubular equipment from said storage area through an opening in the drill floor deck towards the first well centre.

15. An offshore drilling rig according to claim 1, wherein the first pipe handling equipment is operable to move the tubular equipment between the spaced apart support members from a storage structure for storing the tubular equipment, the storage structure being located at least partly behind the load bearing structure when seen from the first well centre.

16. An offshore drilling rig according to claim 1, where said load bearing structure comprises one or more sheaves from which the top drive is suspended via one or more hoisting lines.

17. An offshore drilling rig according to claim 16, wherein said support members of the load bearing structure comprises at least one substantially vertically extending linear actuator having a stationary end being fixed with respect to the drill floor deck, and a travelling end connected to said at least one of one or more sheaves.

18. An offshore drilling rig according to claim 17, comprising a plurality of cylinders extending upwardly relative to the drill floor deck, wherein the plurality of cylinders comprises at least two groups of cylinders that are spaced apart from each other so as to form a gap between the two groups of cylinders through which gap the tubular equipment is movable towards the first well centre from the first side.

19. An offshore drilling rig according to claim 18, wherein the first hoisting system is a hydraulic hoisting system where said at least one substantially vertically extending linear actuator is a hydraulic actuator.

20. An offshore drilling rig according to claim 16, wherein the first hoisting system is a draw works system wherein said one or more sheaves are carried by the first mast so loads to be hoisted are transferred to the drilling vessel via the first mast; and the load bearing structure of the first hoisting system comprises the sheaves and those mast portions that carry the sheaves and any load suspended from the sheaves.

21. An offshore drilling rig according to claim 16, wherein the load bearing structure includes at least two spaced apart support members that bear the weight of said sheaves and of the tubular equipment as it is being hoisted and lowered through the first well centre and wherein the first pipe handling equipment is operable to present said tubular equipment to the top drive in the path from the first side towards the well center where at least part of the tubular equipment passes through a gap between the spaced apart support members.

22. An offshore drilling rig according to claim 16, wherein the load bearing structure includes at least two spaced apart support members, that bear the weight of said sheaves and of the tubular equipment as it is being hoisted and lowered through the first well centre, extending from a foundation above the level of the drill floor deck and wherein the first pipe handling equipment is operable to present said tubular equipment to the top drive in the path from the first side towards the well center where at least part of the tubular equipment passes through a gap in the foundation.

23. An offshore drilling rig according to claim 1, wherein said tubular equipment is a stand of drill pipe.

24. An offshore drilling rig according to claim 1, wherein said tubular equipment is marine riser pipe.

25. An offshore drilling rig comprising:

a drill floor deck having a hole defining a first well centre;

a first mast extending upwardly from the drill floor deck;

a first hoisting system supported by the first mast and configured for hoisting and lowering tubular equipment having a weight through the first well centre;

wherein a load bearing structure of the first hoisting system is displaced from and located on a first side of the first well centre;

first pipe handling equipment for moving tubular equipment to the first hoisting system so as to allow the first hoisting system to hoist or lower the tubular equipment through the first well centre; and a storage structure for storing the tubular equipment chosen from drill pipes, casings, stands of drill pipes and stands of casings, the storage structure being located on the first side of the well centre; and the storage structure being at least partly underneath the drill floor deck or entirely behind the load bearing structure when seen from the first well centre.

26. An offshore drilling rig according to claim 25, wherein the first hoisting system is a hydraulic hoisting system comprising upwardly extending cylinders for carrying the load to be hoisted or lowered via sheaves mounted on top of the cylinders so that the load bearing structure of the first hoisting system comprises the cylinders and the sheaves, wherein the cylinders comprise at least two groups of cylinders that are spaced apart from each other so as to form a gap between the two groups of cylinders through which gap the tubular equipment is movable towards the first well centre from the first side.

27. An offshore drilling rig according to claim 25, wherein the first hoisting system is a draw works system comprising one or more sheaves carried by the mast so loads to be hoisted are transferred to the drilling rig via the mast; and the load bearing structure of the first hoisting system comprises the sheaves and portions of the first mast that carry the sheaves and any load suspended from the sheaves and wherein the first pipe handling equipment is operable to move the tubular equipment between the spaced apart support members.

28. An offshore drilling rig according to claim 25, wherein the first pipe handling equipment is operable to move the tubular equipment between the spaced apart support members from a storage structure for storing the tubular equipment, the storage structure being located at least partly underneath the drill floor deck.

29. An offshore drilling rig according to claim 25, wherein the first mast includes the at least two spaced apart support members.

30. An offshore drilling rig according to claim 25, wherein the load bearing structure includes the at least two spaced apart support members.

31. An offshore drilling rig according to claim 25, wherein the first hoisting system is configured for hoisting and lowering the tubular equipment via a top drive arranged to be raised over said drill floor deck up to a maximum elevation above the drill floor deck, said hoisting system comprising a load bearing structure extending upwardly from the level of the drill floor deck to a height of at least said maximum elevation and from which the top drive is suspended, said load bearing structure supporting a vertical load of said top drive and tubular equipment as it is being hoisted and lowered through the first well centre; and said first mast is:

(iii) comprising a mast portion supporting at least part of said vertical load so that said mast portion forms at least part of said load bearing structure, or (iv) supporting said load bearing structure in a horizontal direction.

32. An offshore drilling rig comprising:

a drill floor deck having a hole defining a first well centre;

a first mast extending upwardly from the drill floor deck;

a first hoisting system supported by the first mast and configured for hoisting and lowering tubular equipment having a weight through the first well centre;

wherein the first mast and a load bearing structure of the first hoisting system are displaced from and located on a first side of the first well centre;

wherein one of the first mast and the load bearing structure includes at least two spaced apart support members that bear the weight of the tubular equipment as it is being hoisted and lowered through the first well centre;

first pipe handling equipment for moving the tubular equipment to the first hoisting system so as to allow the first hoisting system to hoist or lower the tubular equipment through the first well centre; and a storage structure for storing the tubular equipment, the storage structure being located at least partly underneath the drill floor deck and behind the load bearing structure when seen from the first well centre;

wherein the first pipe handling equipment is operable to move the tubular equipment at least partly underneath the load bearing structure or between the at least two spaced apart support members.

33. An offshore drilling rig according to claim 32, wherein the first mast includes the at least two spaced apart support members.

34. An offshore drilling rig according to claim 32, wherein the load bearing structure includes the at least two spaced apart support members.

* * * * *